US008738172B2

(12) United States Patent
Muto et al.

(10) Patent No.: US 8,738,172 B2
(45) Date of Patent: May 27, 2014

(54) COMPUTER CONTROLLED EMBROIDERY SEWING MACHINE WITH CUTTING NEEDLES

(71) Applicants: Yukiyoshi Muto, Nagoyo (JP); Tomotaka Katano, Nagoya (JP)

(72) Inventors: Yukiyoshi Muto, Nagoyo (JP); Tomotaka Katano, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 13/665,242

(22) Filed: Oct. 31, 2012

(65) Prior Publication Data

US 2013/0116815 A1 May 9, 2013

(30) Foreign Application Priority Data

Nov. 9, 2011 (JP) ..... 2011-245189

(51) Int. Cl.
*D05C 5/02* (2006.01)

(52) U.S. Cl.
USPC ..... 700/138

(58) Field of Classification Search
USPC ..... 700/136–138
See application file for complete search history.

(56) References Cited

U.S. PATENT DOCUMENTS 3,765,350 A * 10/1973 Sztari ..... 112/122
5,144,899 A * 9/1992 Allen ..... 112/103
5,361,713 A * 11/1994 Suzuki ..... 112/68
5,555,834 A * 9/1996 Bonner ..... 112/129
6,006,685 A * 12/1999 Kastrup et al. ..... 112/68
7,280,886 B2 * 10/2007 Iida et al. ..... 700/138
7,302,308 B2 * 11/2007 Kato et al. ..... 700/138
7,966,955 B2 * 6/2011 Niizeki ..... 112/89
2010/0050915 A1 3/2010 Konig et al.

FOREIGN PATENT DOCUMENTS

JP A-9-217261 8/1997
WO WO 98/24962 A1 6/1998

OTHER PUBLICATIONS

Sep. 30, 2013 Office Action issued in U.S. Appl. No. 13/664,961.
U.S. Appl. No. 13/664,961, filed Oct. 31, 2012.

* cited by examiner

*Primary Examiner* — Danny Worrell
(74) *Attorney, Agent, or Firm* — Oliff PLC

(57) ABSTRACT

An apparatus includes a processor and a memory configured to store computer-readable instructions that instruct the apparatus to execute steps comprising acquiring pattern data, identifying needle drop points on a pattern line, identifying, as a corresponding cutting needle for each of the plurality of needle drop points, one of cutting needles configured to be attachable to needle bars of a multi-needle sewing machine in a state in which directions of cutting edges are different from each other, storing needle drop point data and cutting needle data in association with each other in the memory, identifying an extending direction of fibers of the work cloth, replacing the cutting needle data in which an angle between the extending direction and the direction of the cutting edge does not satisfy a predetermined relationship, with other data indicating another cutting needle in which the angle satisfies the predetermined relationship, and generating cut data.

9 Claims, 17 Drawing Sheets

FIG. 11

141

| NEEDLE DROP POINT | P(0) | P(1) | ・・・ | P(8) | ・・・ | P(i) | ・・・ | P(74) |
|---|---|---|---|---|---|---|---|---|
| TANGENT LINE 1 | Q(0) (0) | Q(1) (0) | ・・・ | Q(8) (0) | ・・・ | Q(i) (0) | ・・・ | Q(74) (0) |
| TANGENT LINE 2 | Q(0) (1) | Q(1) (1) | ・・・ | Q(8) (1) | ・・・ | Q(i) (1) | ・・・ | Q(74) (1) |
| CUTTING NEEDLE 1 | R(0) (0) | R(1) (0) | ・・・ | R(8) (0) | ・・・ | R(i) (0) | ・・・ | R(74) (0) |
| CUTTING NEEDLE 2 | R(0) (1) | R(1) (1) | ・・・ | R(8) (1) | ・・・ | R(i) (1) | ・・・ | R(74) (1) |

COMPUTER CONTROLLED EMBROIDERY SEWING MACHINE WITH CUTTING NEEDLES

CROSS-REFERENCE TO RELATED APPLICATION

This application claims priority to Japanese Patent Application No. 2011-245189, filed Nov. 9, 2011, the content of which is hereby incorporated herein by reference in its entirety.

BACKGROUND

The present disclosure relates to an apparatus that can generate data that may be used in a sewing machine in order to form cuts in a work cloth along a line indicating a shape of a specified pattern.

A sewing machine is known in which a cutting needle can be attached to a lower end of a needle bar, instead of a sewing needle. The cutting needle is a rod-like member having a sharp cutting edge on its leading end. The sewing machine may cause the cutting needle to move up and down by moving the needle bar up and down, in the same manner as when performing sewing, and repeatedly insert the cutting needle into a work cloth. The sewing machine may cut warp threads and weft threads of the work cloth using the cutting needle, and thereby form cuts in the work cloth. The sewing machine may cause an embroidery frame that holds the work cloth to move in synchronization with the up-down movement of the needle bar. By doing this, the sewing machine can form cuts in the work cloth along a line indicating a shape of a specified pattern.

A sewing machine is known in which two cutting needles can be attached to the lower ends of needle bars, respectively, in a state in which directions of cutting edges on the leading ends of the cutting needles are orthogonal to each other. One of the cutting needles may be attached to the needle bar in a state in which the direction of its cutting edge is orthogonal to a direction in which warp threads of a work cloth extend. The other cutting needle may be attached to the needle bar in a state in which the direction of its cutting edge is orthogonal to a direction in which weft threads of the work cloth extend. The sewing machine may cut the warp threads, using the one of the cutting needles. Then, the sewing machine may cut the weft threads, using the other of the cutting needles. By doing this, the sewing machine can form cuts in the work cloth.

SUMMARY

Depending on a specified pattern, there may be a section in which the direction of the cutting edge of the cutting needle is substantially parallel to the direction in which the warp threads or the weft threads extend. In that section, there is a possibility that the cutting needle cannot cut the warp threads or the weft threads. Accordingly, there may be a case in which the sewing machine cannot reliably form cuts in the work cloth along the line indicating the shape of the specified pattern.

Various embodiments of the broad principles derived herein provide an apparatus that can generate cut data to cause a sewing machine to reliably form cuts in a work cloth along a line indicating a shape of a specified pattern, and a non-transitory computer-readable medium storing computer-readable instructions that cause an apparatus to generate the cut data.

Various embodiments provide an apparatus that includes a processor and a memory. The memory is configured to store computer-readable instructions. The computer-readable instructions instruct the apparatus to execute steps including acquiring pattern data, the pattern data being data representing a position of a point on a pattern line in a case where cuts are formed in a work cloth along the pattern line, which is a line indicating a shape of a pattern, identifying, as a plurality of needle drop points, a plurality of points on the pattern line, each of the plurality of needle drop points being a position at which a cutting needle is to be inserted into the work cloth in order to form a cut, identifying, as a corresponding cutting needle, one of a plurality of cutting needles configured to be attachable to a plurality of needle bars of a multi-needle sewing machine in a state in which directions of cutting edges of the plurality of cutting needles are different from each other, the identifying being performed for each of the plurality of needle drop points, based on a direction in which the pattern line extends at each of the plurality of needle drop points, storing needle drop point data and cutting needle data in association with each other in the memory, the needle drop point data being data indicating each of the plurality of needle drop points, and the cutting needle data being data indicating the cutting needle identified corresponding to each of the plurality of needle drop points, identifying an extending direction of fibers that form the work cloth, replacing the cutting needle data that is included in the cutting needle data stored in the memory and in which an angle between the extending direction and the direction of the cutting edge of the cutting needle indicated by the cutting needle data does not satisfy a predetermined relationship, with other data indicating another cutting needle which is among the plurality of cutting needles and in which the angle satisfies the predetermined relationship, and generating cut data based on the needle drop point data and the cutting needle data stored in the memory, the cut data being data for the multi-needle sewing machine to insert the corresponding cutting needle at each of the plurality of needle drop points along the pattern line.

Embodiments also provide an apparatus that includes a processor and a memory. The memory is configured to store computer-readable instructions. The computer-readable instructions instruct the apparatus to execute steps including acquiring pattern data, the pattern data being data representing a position of a point on a pattern line in a case where cuts are formed in a work cloth along the pattern line, which is a line indicating a shape of a pattern, identifying, as a plurality of needle drop points, a plurality of points on the pattern line, each of the plurality of needle drop points being a position at which a cutting needle is to be inserted into the work cloth in order to form a cut, identifying an extending direction of fibers that form the work cloth, identifying, among a plurality of cutting needles configured to be attachable to a plurality of needle bars of a multi-needle sewing machine in a state in which directions of cutting edges of the plurality of cutting needles are different from each other, a cutting needle in which an angle between the identified extending direction and the direction of the cutting edge satisfies a predetermined relationship, and generating cut data, the cut data being data for the multi-needle sewing machine to insert the identified cutting needle at each of the plurality of needle drop points on the pattern line.

Embodiments further provide a non-transitory computer-readable medium storing computer-readable instructions. The computer-readable instructions instruct an apparatus to execute steps including acquiring pattern data, the pattern data being data representing a position of a point on a pattern line in a case where cuts are formed in a work cloth along the pattern line, which is a line indicating a shape of a pattern, identifying, as a plurality of needle drop points, a plurality of points on the pattern line, each of the plurality of needle drop points being a position at which a cutting needle is to be inserted into the work cloth in order to form a cut, identifying, as a corresponding cutting needle, one of a plurality of cutting needles configured to be attachable to a plurality of needle bars of a multi-needle sewing machine in a state in which directions of cutting edges of the plurality of cutting needles are different from each other, the identifying being performed for each of the plurality of needle drop points, based on a direction in which the pattern line extends at each of the plurality of needle drop points, storing needle drop point data and cutting needle data in association with each other in the memory, the needle drop point data being data indicating each of the plurality of needle drop points, and the cutting needle data being data indicating the cutting needle identified corresponding to each of the plurality of needle drop points, identifying an extending direction of fibers that form the work cloth, replacing the cutting needle data that is included in the cutting needle data stored in the memory and in which an angle between the extending direction and the direction of the cutting edge of the cutting needle indicated by the cutting needle data does not satisfy a predetermined relationship, with other data indicating another cutting needle which is among the plurality of cutting needles and in which the angle satisfies the predetermined relationship, and generating cut data based on the needle drop point data and the cutting needle data stored in the memory, the cut data being data for the multi-needle sewing machine to insert the corresponding cutting needle at each of the plurality of needle drop points along the pattern line.

BRIEF DESCRIPTION OF THE DRAWINGS

Embodiments will be described below in detail with reference to the accompanying drawings in which:

FIG. 11 is an explanatory diagram of a table;

DETAILED DESCRIPTION

Hereinafter, an embodiment will be explained with reference to the drawings. A configuration of a multi-needle sewing machine (hereinafter simply referred to as a sewing machine) 1 according to the embodiment will be explained with reference to FIG. 1 to FIG. 3. The upper side, the lower side, the lower left side, the upper right side, the upper left side and the lower right side of FIG. 1 respectively correspond to the upper side, the lower side, the front side, the rear side, the left side and the right side of the sewing machine 1.

Figure 1:
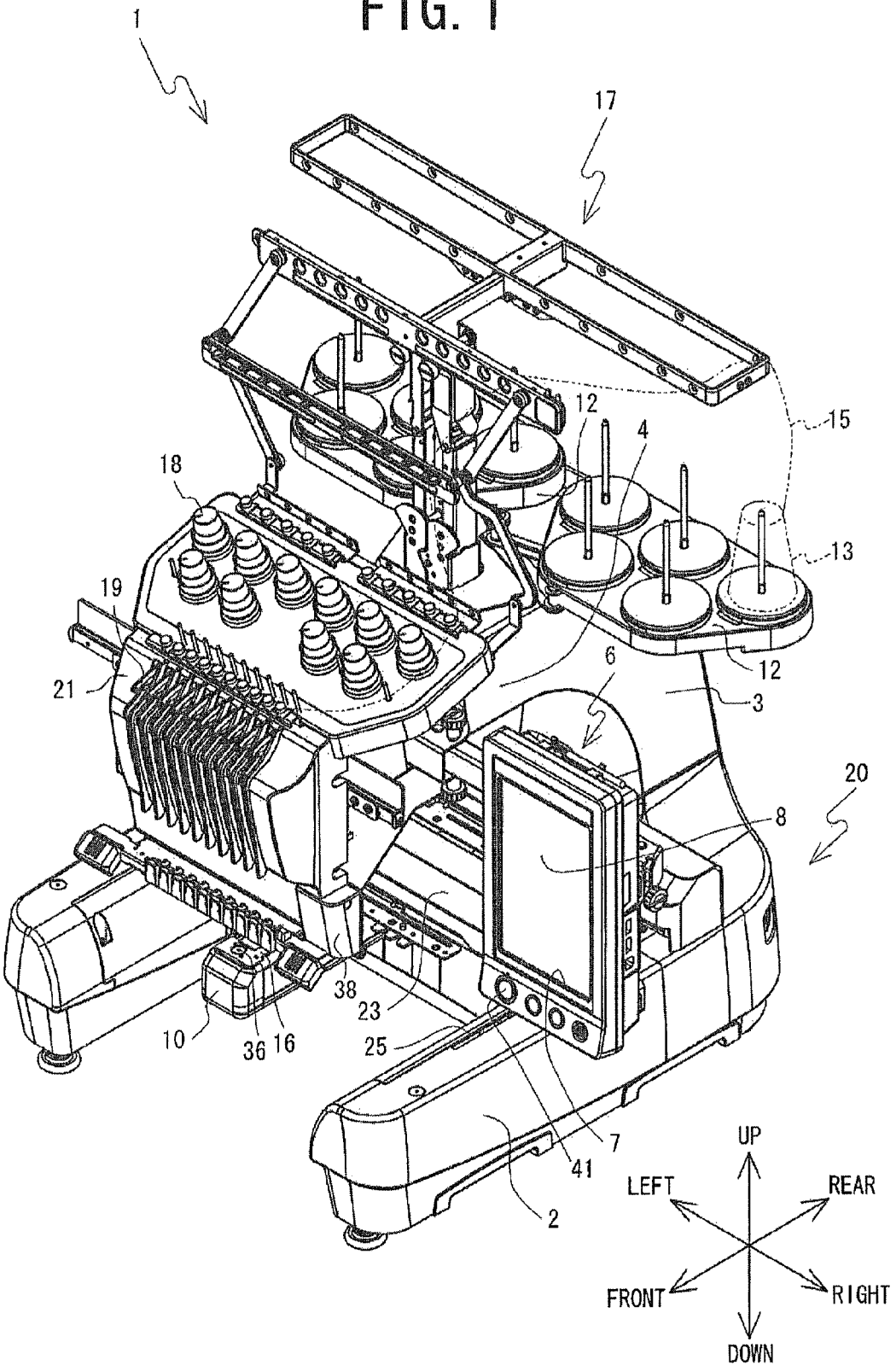
FIG. 1 is a perspective view of a sewing machine.

As shown in FIG. 1, a main body 20 of the sewing machine 1 includes a support portion 2, a pillar 3 and an arm portion 4. The support portion 2 is a base portion that is formed in an inverted U-shape in a plan view. A pair of left and right guide grooves 25, which extend in a front-rear direction, are provided in an upper surface of the support portion 2. The pillar 3 extends upward from a rear end portion of the support portion 2. The arm portion 4 extends to the front from an upper end portion of the pillar 3. A needle bar case 21 is attached to the front end of the arm portion 4 such that the needle bar case 21 can move in a left-right direction. Ten needle bars 31 (refer to FIG. 2), which extend in an up-down direction, are disposed inside the needle bar case 21 at an equal interval in the left-right direction. One of the ten needle bars 31 that is in a sewing position may be caused to slide in the up-down direction by a needle bar drive mechanism 32 (refer to FIG. 4) that is provided inside the needle bar case 21. One of a sewing needle 51 and a cutting needle 52 (refer to FIG. 2) can be detachably attached to the lower end of each of the needle bars 31.

Figure 2:
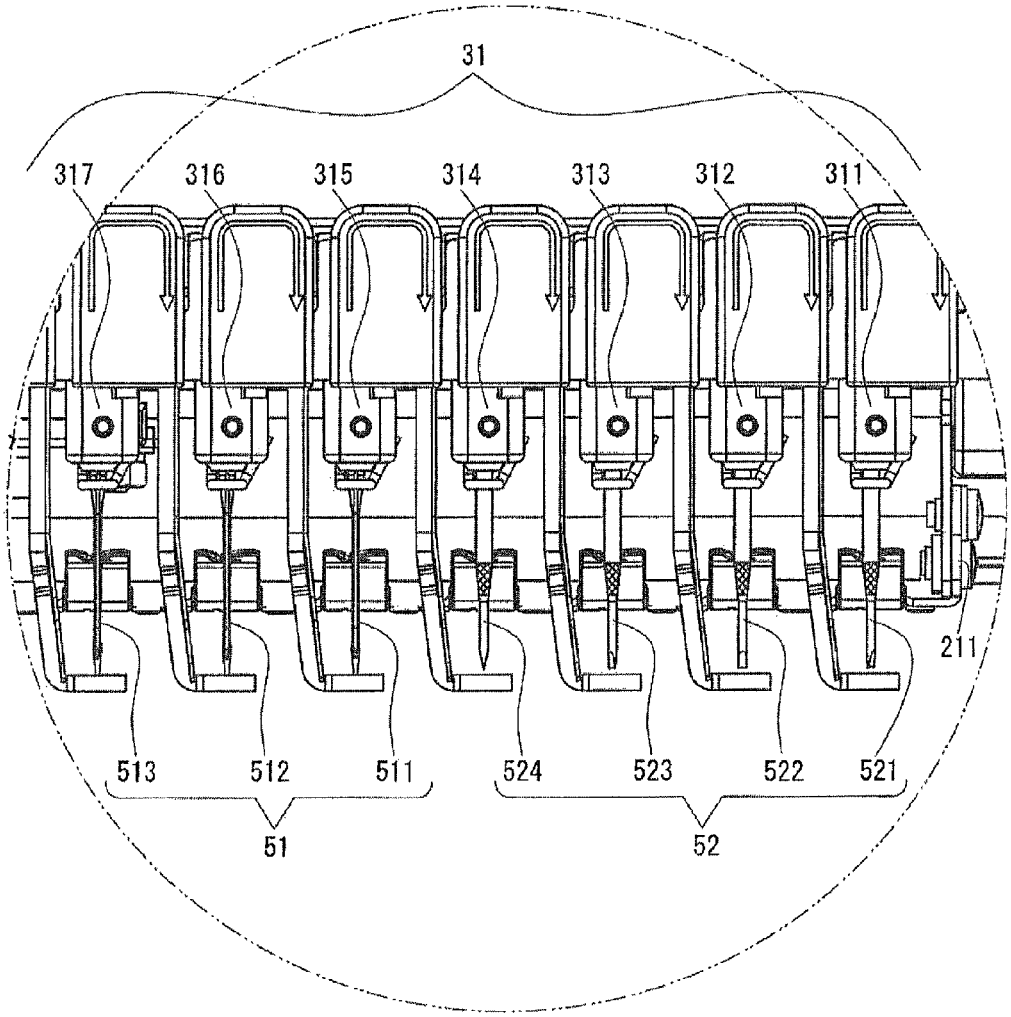
FIG. 2 is a partial front view of a lower end portion of a needle bar case 21.

The sewing needles 51 and the cutting needles 52 will be explained with reference to FIG. 2. Note that, of the ten needle bars 31, only the seven needle bars 31 on the right side are shown in FIG. 2. The sewing needles 51 can be attached to six of the ten needle bars 31, more specifically, the fifth to tenth needle bars 31 from the right. FIG. 2 shows a state in which the sewing needles 51 (sewing needles 511, 512 and 513) are attached to fifth to seventh needle bars 315, 316 and 317 from the right. The sewing machine 1 may slidingly move the needle bar 31, to which the sewing needle 51 is attached, in the up-down direction and thereby cause the sewing needle 51 to repeatedly reciprocate in the up-down direction. By doing this, the sewing machine 1 can perform sewing on a work cloth 39 (refer to FIG. 3).

As shown in FIG. 2, the cutting needles 52 (cutting needles 521, 522, 523 and 524) can be attached to four of the ten needle bars 31 on the right side (needle bars 311, 312, 313 and 314). Each of the cutting needles 52 has a cutting edge to form a cut in the work cloth 39 (refer to FIG. 3) on its lower end. A shaft portion provided in an upper portion of the cutting needle 52 has a partially cylindrical shape, a side surface of which is a flat surface. A positional relationship between a cutting edge direction and the flat surface formed in the shaft portion varies for each of the cutting needles 521 to 524. In a state in which the flat surface of the shaft portion of each of the cutting needles 52 faces the rear of the sewing machine 1, each of the cutting needles 52 can be attached to one of the needle bars 31. Therefore, the plurality of cutting needles 52 can be attached to the sewing machine 1 in a state in which directions of the cutting edges are different from each other. Note that, the direction of the cutting edge is a direction of the cutting edge when the cutting needle 52 forms a cut in the work cloth 39. In other words, the direction of the cutting edge means a direction of the cut to be formed in the work cloth 39.

When the cutting needle 521 is attached to the sewing machine 1, the direction of the cutting edge of the cutting needle 521 extends in a direction diagonally from the front left to the rear right. When the cutting needle 522 is attached to the sewing machine 1, the direction of the cutting edge of the cutting needle 522 extends in the left-right direction. When the cutting needle 523 is attached to the sewing machine 1, the direction of the cutting edge of the cutting needle 523 extends in a direction diagonally from the front right to the rear left. When the cutting needle 524 is attached to the sewing machine 1, the direction of the cutting edge of the cutting needle 524 extends in the front-rear direction. The sewing machine 1 may slidingly move the needle bar 31, to which the cutting needle 52 is attached, in the up-down direction and thereby cause the cutting needle 52 to repeatedly reciprocate in the up-down direction. By doing this, the sewing machine 1 can form cuts in the work cloth 39. As will be described in detail later, the sewing machine 1 can sequentially form the cuts in the work cloth 39 while switching the cutting needles 521 to 524.

As shown in FIG. 1, a cover 38 is provided on a lower portion of a right side surface of the needle bar case 21. An image sensor 50 (refer to FIG. 4) is provided inside the cover 38. The image sensor 50 may be a known complementary metal oxide semiconductor (CMOS) image sensor. The image sensor 50 can capture an image of the work cloth 39 (refer to FIG. 3) held by the embroidery frame 84, and can output image data of the captured image.

An operation portion 6 is provided on the right side of a central portion in the front-rear direction of the arm portion 4. The operation portion 6 includes a liquid crystal display (hereinafter referred to as an LCD) 7, a touch panel 8 and a start/stop switch 41. For example, an image including various types of items, such as a command, an illustration, a setting value and a message etc., may be displayed on the LCD 7 based on image data. The touch panel 8 is provided on a front surface of the LCD 7. A user can perform a pressing operation on the touch panel 8, using a finger or a touch pen. This operation is hereinafter referred to as a panel operation. The touch panel 8 may detect a position pressed by the finger or the touch pen, and the sewing machine 1 (more specifically, a CPU 61 to be described later) may recognize the item that corresponds to the detected position. In this manner, the sewing machine 1 may recognize the selected item. The user can select a pattern, a cutting condition, a command to be executed, or the like, by performing a panel operation. The start/stop switch 41 is a switch that is used to input, to the sewing machine 1, a command to start or stop sewing or forming of cuts.

A cylinder-shaped cylinder bed 10, which extends to the front from a lower end portion of the pillar 3, is provided below the arm portion 4. A shuttle (not shown in the drawings) is provided inside a front end portion of the cylinder bed 10. The shuttle can house a bobbin (not shown in the drawings) on which a bobbin thread (not shown in the drawings) is wound. A shuttle drive mechanism (not shown in the drawings) is provided inside the cylinder bed 10. The shuttle drive mechanism (not shown in the drawings) may rotatably drive the shuttle. A needle plate 16, having a rectangular shape in a plan view, is provided in the upper face of the cylinder bed 10. The needle plate 16 is provided with a needle hole 36 through which the sewing needle 51 can pass.

A pair of left and right thread spool bases 12 are provided on a rear portion of an upper surface of the arm portion 4. The number of the thread spools 13 that can be mounted on the pair of the thread spool bases 12 is ten, which is the same as the number of the needle bars 31. A needle thread 15 may be supplied from one of the thread spools 13 mounted on the thread spool bases 12. The needle thread 15 may be supplied, via a thread guide 17, a tensioner 18, a thread take-up lever 19 and the like, to an eye (not shown in the drawings) of each of the sewing needles 51 that are attached to the lower end of each of the needle bars 31.

A Y carriage 23 of an embroidery frame movement mechanism 11 (refer to FIG. 4) is provided below the arm portion 4. Various types of the embroidery frame 84 (refer to FIG. 3) can be attached to the embroidery frame movement mechanism 11. The embroidery frame 84 is configured to hold the work cloth 39. The embroidery frame movement mechanism 11 may cause the embroidery frame 84 to move back and forth and left and right, using an X-axis motor 132 (refer to FIG. 4) and a Y-axis motor 134 (refer to FIG. 4) as driving sources.

Figure 3:
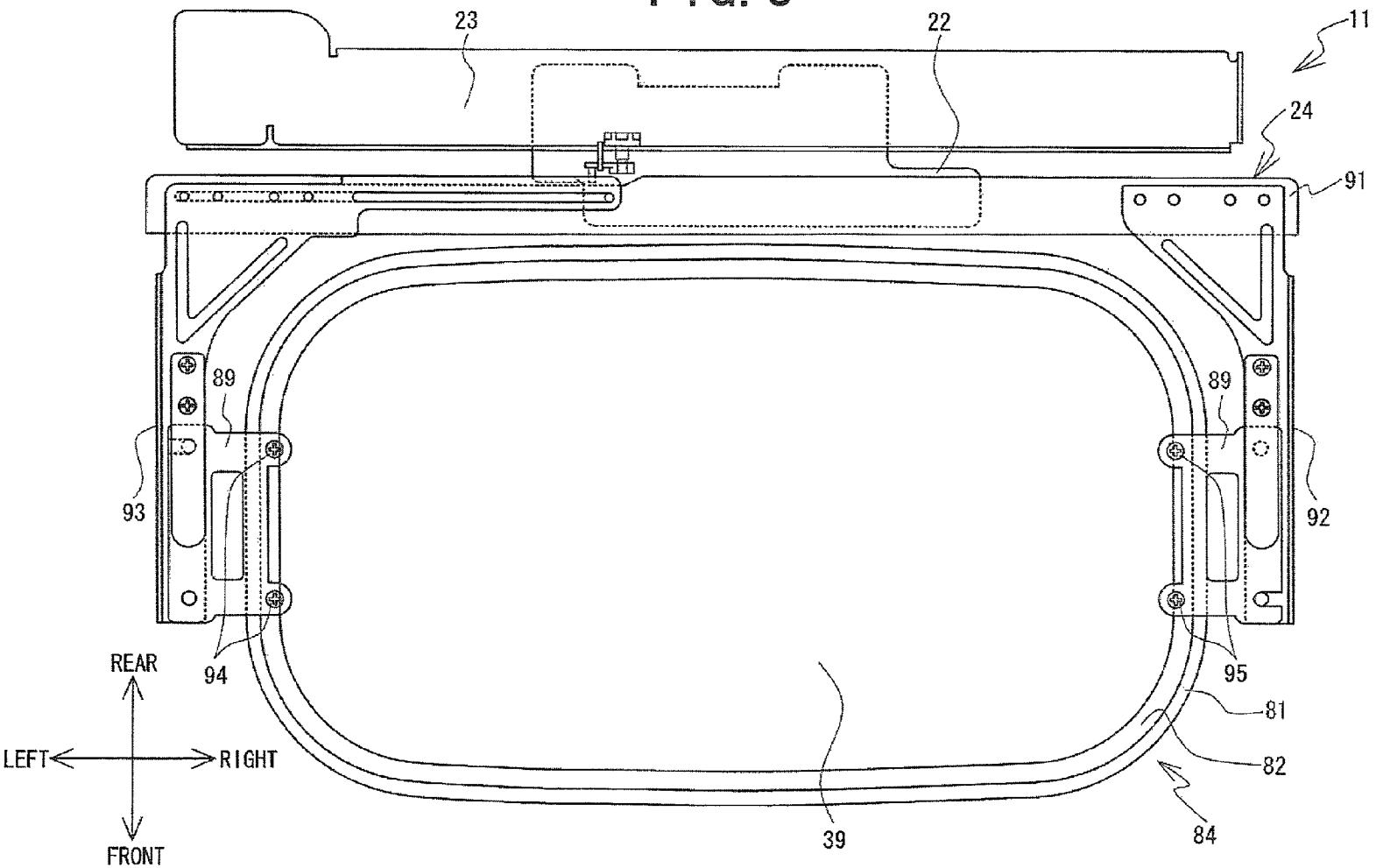
FIG. 3 is a plan view of an embroidery frame movement mechanism to which an embroidery frame is attached.

The embroidery frame 84 and the embroidery frame movement mechanism 11 will be explained with reference to FIG. 3. The embroidery frame 84 includes an outer frame 81, an inner frame 82 and a pair of left and right coupling portions 89. The outer frame 81 and the inner frame 82 of the embroidery frame 84 may clamp the work cloth 39. The coupling portions 89 are plate members having a rectangular shape in a plan view, and their central portions are cut out in a rectangular shape. One of the coupling portions 89 is fixed to a right portion of the inner frame 82 by screws 95. The other of the coupling portions 89 is fixed to a left portion of the inner frame 82 by screws 94.

The embroidery frame movement mechanism 11 includes a holder 24, an X carriage 22, an X-axis drive mechanism (not shown in the drawings), the Y carriage 23 and a Y-axis movement mechanism (not shown in the drawings). The holder 24 is configured to detachably support the embroidery frame 84. The holder 24 includes a mounting portion 91, a right arm portion 92 and a left arm portion 93. The mounting portion 91 is a plate member having a rectangular shape in a plan view, and it is longer in the left-right direction. The right arm portion 92 extends in the front-rear direction, and a rear end portion of the right arm portion 92 is fixed to the right end of the mounting portion 91. The left arm portion 93 extends in the front-rear direction. A rear end portion of the left arm portion 93 is fixed to a left portion of the mounting portion 91 such that the position in the left-right direction with respect to the mounting portion 91 can be adjusted. The right arm portion 92 may be engaged with the one of the coupling portions 89. The left arm portion 93 may be engaged with the other of the coupling portions 89.

The X carriage 22 is a plate member and is longer in the left-right direction. A part of the X carriage 22 protrudes toward the front from the front face of the Y carriage 23. The mounting portion 91 of the holder 24 may be attached to the X carriage 22. The X-axis drive mechanism (not shown in the drawings) includes a linear movement mechanism (not shown in the drawings). The linear movement mechanism includes a timing pulley (not shown in the drawings) and a timing belt (not shown in the drawings). The linear movement mechanism may cause the X carriage 22 to move in the left-right direction (in the X-axis direction), using the X-axis motor 132 as a driving source.

The Y carriage 23 is a box-shaped member that is longer in the left-right direction. The Y carriage 23 supports the X carriage 22 such that the X carriage 22 can move in the left-right direction. The Y-axis movement mechanism (not shown in the drawings) includes a pair of left and right movable members (not shown in the drawings) and a linear movement mechanism (not shown in the drawings). The movable members are connected to lower portions of the left and right ends of the Y carriage 23, and vertically pass through the guide grooves 25 (refer to FIG. 1). The linear movement mechanism includes a timing pulley (not shown in the drawings) and a timing belt (not shown in the drawings). The linear movement mechanism may cause the movable members to move in the front-rear direction (in the Y-axis direction) along the guide grooves 25, using the Y-axis motor 134 as a driving source. The Y carriage 23 that is connected to the movable members, and the X carriage 22 that is supported by the Y carriage 23 may move in the front-rear direction (in the Y-axis direction) in accordance with movement of the movable members. In a state in which the embroidery frame 84 that holds the work cloth 39 is attached to the X carriage 22, the work cloth 39 is disposed between the needle bars 31 and the needle plate 16 (refer to FIG. 1).

Figure 4:
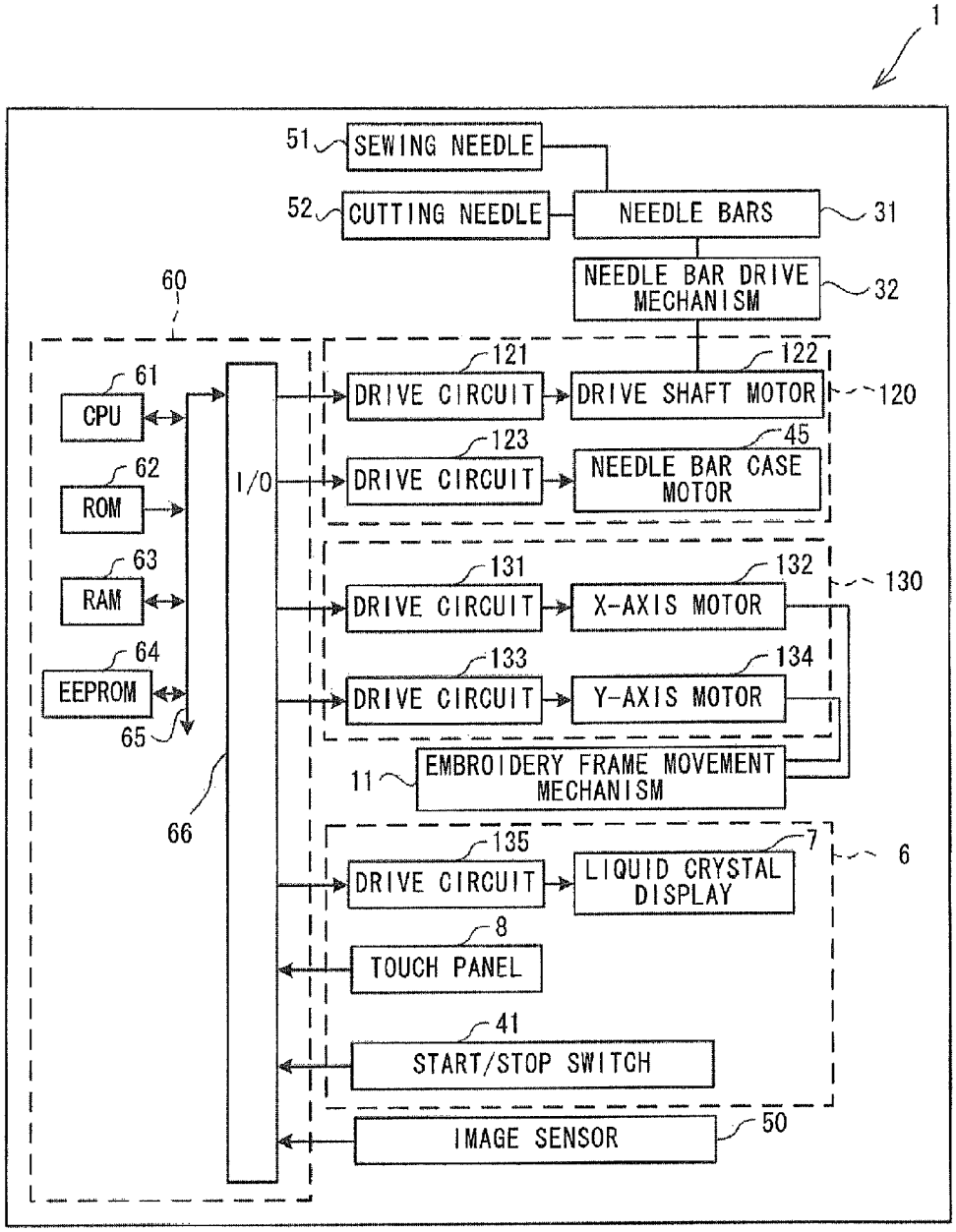
FIG. 4 is a block diagram showing an electrical configuration of the sewing machine.

An electrical configuration of the sewing machine 1 will be explained with reference to FIG. 4. As shown in FIG. 4, the sewing machine 1 includes a sewing needle drive portion 120, a sewing target drive portion 130, the operation portion 6, a control portion 60 and the image sensor 50. Hereinafter, the sewing needle drive portion 120, the sewing target drive portion 130, the operation portion 6 and the control portion 60 will be described in detail in order.

The sewing needle drive portion 120 includes a drive circuit 121, a drive shaft motor 122, a drive circuit 123 and a needle bar case motor 45. The drive circuit 121 may drive the drive shaft motor 122 in accordance with a control signal from the control portion 60. The drive shaft motor 122 may drive the needle bar drive mechanism 32 by rotatably driving a drive shaft (not shown in the drawings), and causes the needle bar 31 to reciprocate in the up-down direction. The drive circuit 123 may drive the needle bar case motor 45 in accordance with a control signal from the control portion 60. The needle bar case motor 45 may drive a movement mechanism not shown in the drawings and thereby causes the needle bar case 21 to move in the left-right direction.

The sewing target drive portion 130 includes a drive circuit 131, the X-axis motor 132, a drive circuit 133 and the Y-axis motor 134. The drive circuit 131 may drive the X-axis motor 132 in accordance with a control signal from the control portion 60. The X-axis motor 132 may drive the embroidery frame movement mechanism 11 and thereby cause the embroidery frame 84 (refer to FIG. 3) to move in the left-right direction. The drive circuit 133 may drive the Y-axis motor 134 in accordance with a control signal from the control portion 60. The Y-axis motor 134 may drive the embroidery frame movement mechanism 11 and thereby cause the embroidery frame 84 to move in the front-rear direction.

The operation portion 6 includes a drive circuit 135, the LCD 7, the touch panel 8 and the start/stop switch 41. The drive circuit 135 may drive the LCD 7 in accordance with a control signal from the control portion 60.

The control portion 60 includes the CPU 61, a ROM 62, a RAM 63, an EEPROM 64 and an input/output (I/O) interface 66, and they are mutually connected by a signal line 65. The sewing needle drive portion 120, the sewing target drive portion 130, the operation portion 6 and the image sensor 50 are respectively connected to the I/O interface 66. Hereinafter, the CPU 61, the ROM 62, the RAM 63 and the EEPROM 64 will be described in detail.

The CPU 61 is configured to perform main control of the sewing machine 1. The CPU 61 may perform various operations and processing that relate to sewing, in accordance with various programs stored in a program storage area (not shown in the drawings) of the ROM 62. Although not shown in the drawings, the ROM 62 includes a plurality of storage areas including the program storage area. Various programs to operate the sewing machine 1, including a main program, may be stored in the program storage area. The main program is a program to perform main processing, which will be described later. The RAM 63 includes, as necessary, storage areas to store data such as operation results etc. processed by the CPU 61. Various parameters for the sewing machine 1 to perform various types of processing may be stored in the EEPROM 64.

The main processing will be explained with reference to FIG. 5 to FIG. 8. In the main processing, cut data is generated (step S11 to step S19, which will be described later). The cut data is control data that is necessary to cause the sewing machine 1 to perform operations to form cuts in the work cloth 39 along a line (hereinafter referred to as a pattern line) that indicates a shape of a pattern. The sewing machine 1 is configured to move the embroidery frame 84 based on the generated cut data. As a result, the position of the work cloth 39 with respect to the cutting needle 52 may change. The sewing machine 1 may slidingly and vertically move the needle bar 31 to which the cutting needle 52 is attached. The sewing machine 1 may repeat the movement of the embroidery frame 84 and the vertical movement of the needle bar 31 based on the cut data, and thereby form cuts in the work cloth 39 along the pattern line (step S25, which will be described later).

Figure 5:
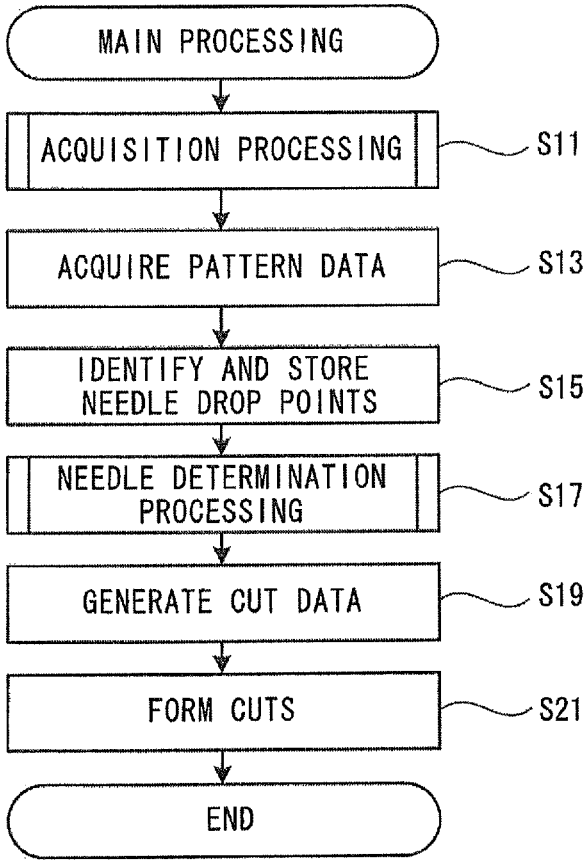
FIG. 5 is a flowchart of main processing.

The main processing shown in FIG. 5 is performed when the user inputs a command to start the main processing. The command to start the main processing may be input by a panel operation, for example. The program to perform the main processing is stored in the ROM 62 (refer to FIG. 4) and is performed by the CPU 61. As shown in FIG. 5, in the main processing, the CPU 61 first performs processing (acquisition processing, refer to FIG. 6) to acquire an extending direction of fibers that form the work cloth 39 held by the embroidery frame 84 (refer to FIG. 3) (step S11). The work cloth 39 exemplified in the present embodiment is a woven fabric formed by warp threads and weft threads that are orthogonal to the warp threads. The extending direction of the fibers may refer to one or more of a direction in which the warp threads extend and a direction in which the weft threads extend.

Figure 6:
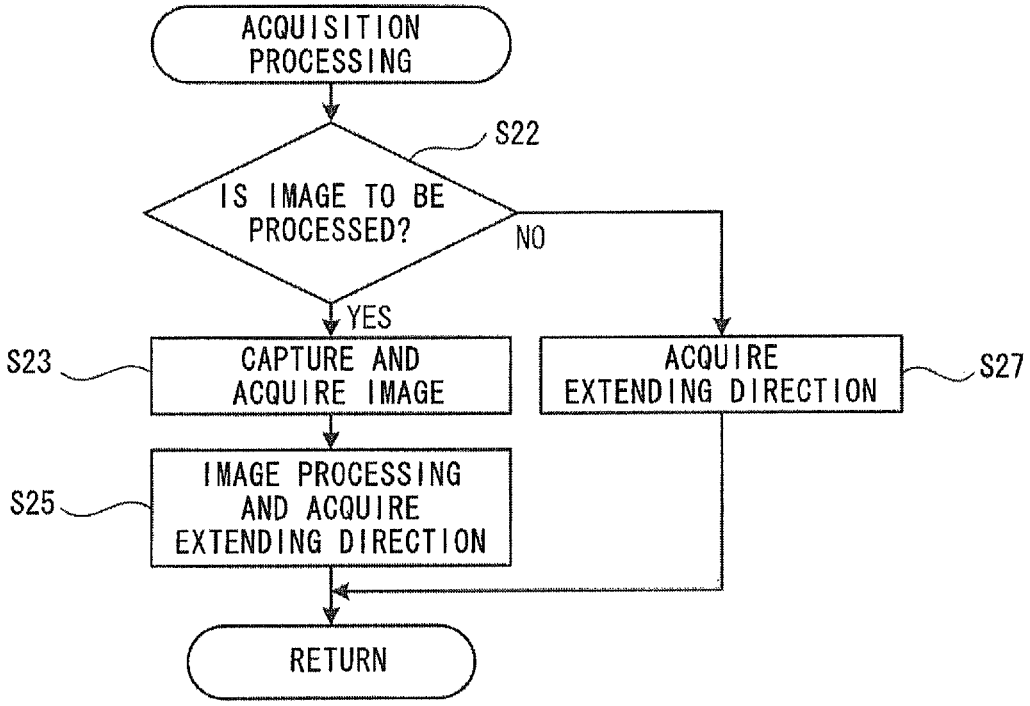
FIG. 6 is a flowchart of acquisition processing.

The acquisition processing will be explained with reference to FIG. 6. In the acquisition processing, the CPU 61 acquires the extending direction of the fibers that form the work cloth 39, using one of the following two methods. The first method is a method that acquires the extending direction of the fibers by performing image processing on the image data of the captured image of the work cloth 39. The second method is a method that acquires, as the extending direction of the fibers, a direction input by the user performing a panel operation. The CPU 61 displays, on the LCD 7 (refer to FIG. 1), a screen that enables the user to select one of the methods. The user performs a panel operation to select one of the methods.

The CPU 61 determines which method is selected, in accordance with a pressed position detected by the touch panel 8 (step S22). In a case where the CPU 61 recognizes that the method is selected that acquires the extending direction by image processing (yes at step S22), the CPU 61 controls the image sensor 50 such that the image sensor 50 starts image capture. The image sensor 50 captures an image of the work cloth 39 and outputs the captured image. The CPU 61 acquires the captured image output from the image sensor 50 (step S23). The CPU 61 processes the captured image and thereby acquires the extending direction of the fibers that form the work cloth 39 (step S25). The CPU 61 stores the acquired extending direction in the RAM 63. The CPU 61 ends the acquisition processing and returns to the main processing (refer to FIG. 5).

Any known method can be used as a method to acquire the extending direction of the fibers by image processing. For example, the CPU 61 can use the following method. The CPU 61 performs binary processing on the captured image and thereafter performs a Fourier transform. The CPU 61 averages the Fourier coefficient amplitudes obtained by the Fourier transform, and identifies a line segment in the captured image. The CPU 61 can identify, as the extending direction of the fibers, a direction in which the identified line segment extends. Note that the above-described method is merely an example. The CPU 61 may perform image processing by another method and acquire the extending direction of the fibers.

In a case where the CPU 61 recognizes that the method is selected in which the direction input by a panel operation is identified as the extending direction (no at step S22), the CPU 61 displays on the LCD 7 a screen on which the extending direction of the fibers can be input. The user inputs a direction by a panel operation. The CPU 61 acquires the input direction as the extending direction of the fibers (step S27). The CPU 61 stores, in the RAM 63, the acquired extending direction. The CPU 61 ends the acquisition processing and returns to the main processing (refer to FIG. 5).

For example, the following method can be used as a specific method that allows the user to input the extending direction of the fibers. For example, the CPU 61 displays on the LCD 7 the captured image of the work cloth 39 acquired from the image sensor 50. The CPU 61 displays on the LCD 7 a plurality of arrows that are oriented in different directions, together with the captured image. The user refers to the captured image of the work cloth 39 and selects, via the touch panel 8, one of the arrows that is oriented in a direction closest to the extending direction of the fibers, that is, the direction in which either the warp threads or the weft threads that form the work cloth 39 extend. The CPU 61 acquires, as the extending direction of the fibers, the direction of the arrow selected by the user. Alternatively, for example, on the displayed captured image of the work cloth 39, the user may input a line segment along the direction in which either the warp threads or the weft threads extend, using a touch pen. The CPU 61 may then acquire, as the extending direction of the fibers, the direction of the line segment input by the user. Further, for example, the CPU 61 may display on the LCD 7 a window on which the extending direction of the fibers can be input as an angle. The user may directly input the angle via the touch panel 8. The CPU 61 may acquire the input angle information, as the extending direction of the fibers. Note that the above-described methods are merely examples. The CPU 61 may display the screen on the LCD 7 so that the user can input the extending direction by another method.

Figure 9:
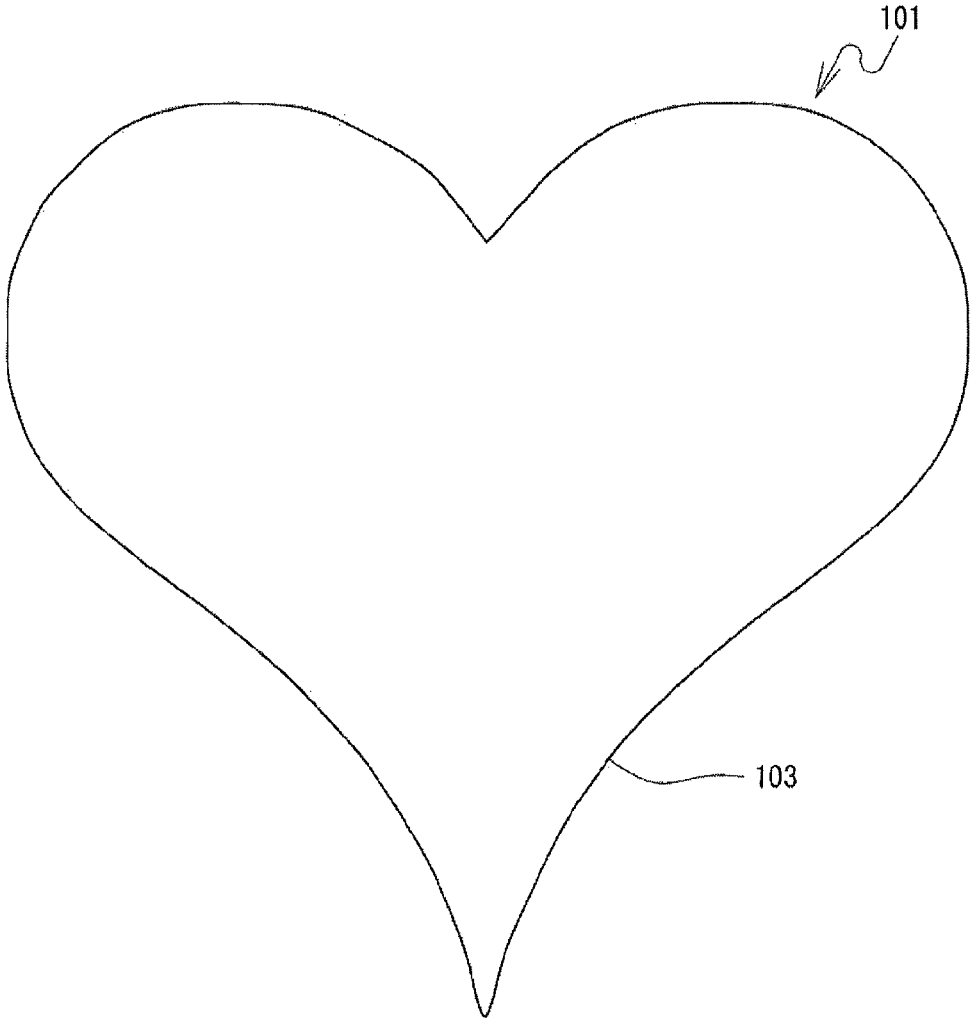
FIG. 9 is an explanatory diagram of a pattern.

As shown in FIG. 5, after the extending direction of the fibers is acquired by the acquisition processing (step S11), the CPU 61 acquires pattern data (step S13). Specifically, the user inputs a pattern line by a panel operation. The pattern data is data that can specify a position of a given point on the pattern line with respect to the work cloth 39, in a case where cuts are formed along the pattern line on the work cloth 39. The pattern data may be, for example, vector data. For example, in a case where a pattern line 103 of a heart-shaped pattern 101 shown in FIG. 9 is input, the CPU 61 acquires pattern data that represents the pattern line 103 and stores the acquired pattern data in the RAM 63.

The CPU 61 may acquire the pattern data by another method. For example, the user may input a plurality of points as a pattern line by a panel operation. The CPU 61 may acquire data representing line segments that connect the plurality of specified points as the pattern data. Further, for example, the sewing machine 1 may be provided with a card slot not shown in the drawings. The user may insert a memory card, on which the pattern data is stored, into the card slot. The CPU 61 may acquire the pattern data by reading out the pattern data stored on the memory card inserted into the card slot.

Figure 10:
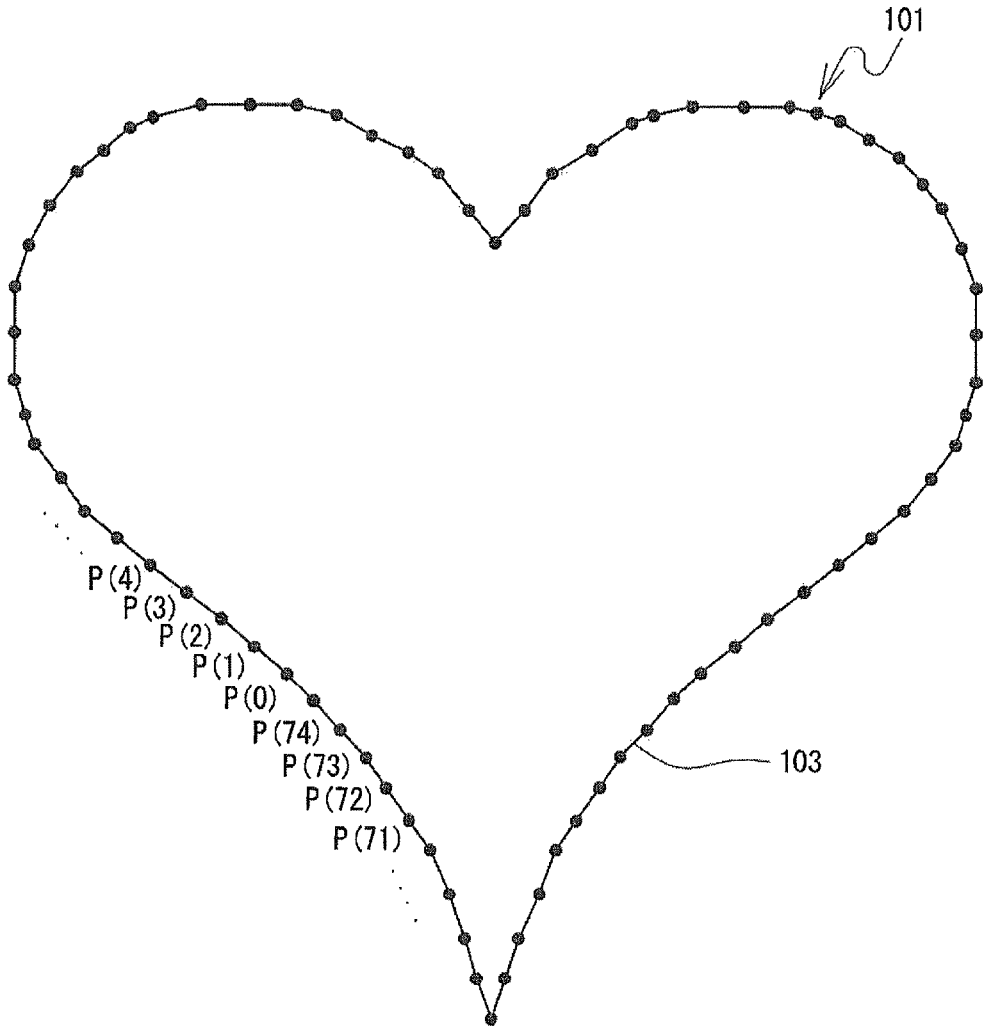
FIG. 10 is an explanatory diagram of needle drop points set on a pattern line.

The CPU 61 identifies, as needle drop points, points on the pattern line indicated by the pattern data stored in the RAM 63 (step S15). For example, in the case of the pattern 101 shown in FIG. 9, the CPU 61 identifies the needle drop points such that the needle drop points are arranged at an equal interval on the pattern line 103. In this case, needle drop points P(i) (i=0 . . . 74) are identified on the pattern line 103, as shown in FIG. 10. Note that the numeric values i are assigned to the identified needle drop points in order along the pattern line 103, where the numeric value of a particular needle drop point on the pattern line 103 is taken as 0. The data indicating positions of the identified needle drop points P(i) is stored in the table 141 provided in the RAM 63, as shown in FIG. 11. Note that hereinafter the data that indicates the position of the needle drop point P(i) stored in the table 141 is also simply referred to as the needle drop point P(i).

The CPU 61 may identify the needle drop point using another method. For example, the CPU 61 may display a pattern line represented by the acquired pattern data on the LCD 7. The user may select and input a given point by a panel operation on the pattern line displayed on the LCD 7. The CPU 61 may identify the point input by the user as the needle drop point.

The CPU 61 performs processing (needle determination processing, refer to FIG. 7) that identifies one of the cutting needles 521 to 524 for each of the needle drop points identified at step S15, as the cutting needle 52 that is to be inserted at each of the needle drop points (step S17). The needle determination processing will be explained with reference to FIG. 7. In the needle determination processing, first, the CPU 61 performs initialization by substituting 0 for a variable i that is stored in the RAM 63 (step S31). The CPU 61 compares the variable i with a total number of the needle drop points P(i) identified at step S15 (refer to FIG. 5), and determines whether or not the variable i is less than the total number of the needle drop points P(i) (step S33). When the variable i is repeatedly updated at step S43 (to be described later) and the variable i is equal to or more than the total number of the needle drop points P(i) (no at step S33), it means that the cutting needles 52 corresponding to all the needle drop points P(i) have been identified. In this case, the CPU 61 ends the needle determination processing and returns to the main processing (refer to FIG. 5). When the variable i is less than the total number of the needle drop points P(i) (yes at step S33), the CPU 61 identifies tangent lines Q(i)(j) (j=0, 1) of the pattern line at the needle drop point P(i) in the following manner (step S35). Note that, strictly speaking, Q(i)(j) is a line segment indicating a direction in which the pattern line extends at the needle drop point P(i), and is not the actual tangent line of the pattern line at the needle drop point P(i). However, in the present embodiment, in order to simplify the explanation, Q(i)(j) is referred to as the tangent line.

Figure 12:
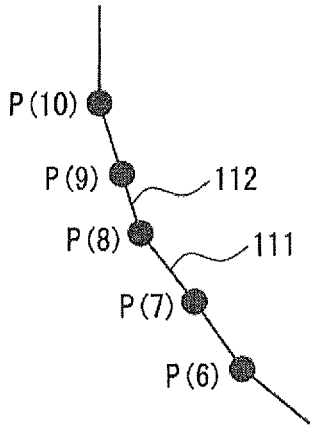
FIG. 12 is an explanatory diagram of an identification method of a cutting needle.

Referring to FIG. 12, an identification method of the tangent lines at the needle drop point P(8), which is one of the needle drop points P(i), will be specifically explained using an example. First, based on the data that indicates the positions of the needle drop points P(7), P(8) and P(9), the CPU 61 defines line segments 111 and 112 that respectively connect the adjacent two needle drop points P(8) and P(7) and the adjacent two needle drop points P(8) and P(9). The CPU 61 identifies the defined line segments 111 and 112 as a tangent line Q(8)(0) and a tangent line Q(8)(1) at the needle drop point P(8). Thus, two tangent lines are identified for the single needle drop point P(8). Data indicating angles of the identified tangent lines Q(8)(j) (j=0, 1) is associated with the needle drop point P(8) and stored in the table 141, as shown in FIG. 11. Hereinafter, the data indicating the angle of the tangent line Q(i)(j) stored in the table 141 is also simply referred to as the tangent line Q(i)(j).

Figure 7:
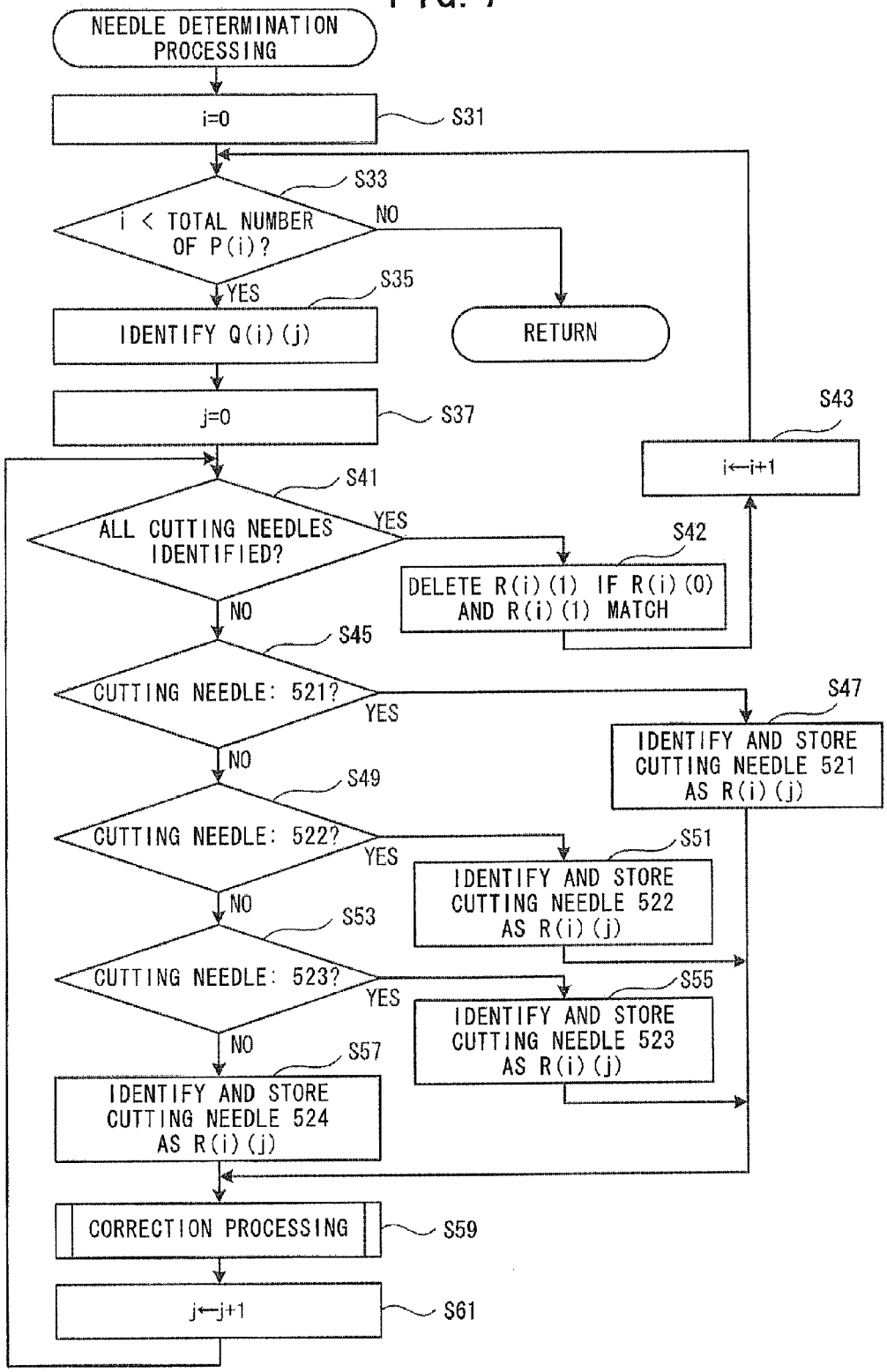
FIG. 7 is a flowchart of needle determination processing.

As shown in FIG. 7, after the tangent lines Q(i)(j) corresponding to the needle drop point P(i) are identified at step S35, the CPU 61 performs initialization by substituting 0 for a variable j that is stored in the RAM 63 (step S37). The CPU 61 determines whether or not, of the two tangent lines Q(i)(j) corresponding to the needle drop point P(i), the tangent line Q(i)(j) for which processing (step S45 to step S57, which will be described later) to identify the cutting needle 52 is not completed remains in the table 141 (step S41). In a case where the tangent line Q(i)(j) for which the identification of the cutting needle 52 is not completed remains in the table 141 (no at step S41), the CPU 61 performs the processing from step S45 to step S57 based on the tangent line Q(i)(j) for which the identification of the cutting needle 52 is not completed, and identifies the cutting needle 52 that corresponds to the needle drop point P(i), in the following manner.

Figure 13:
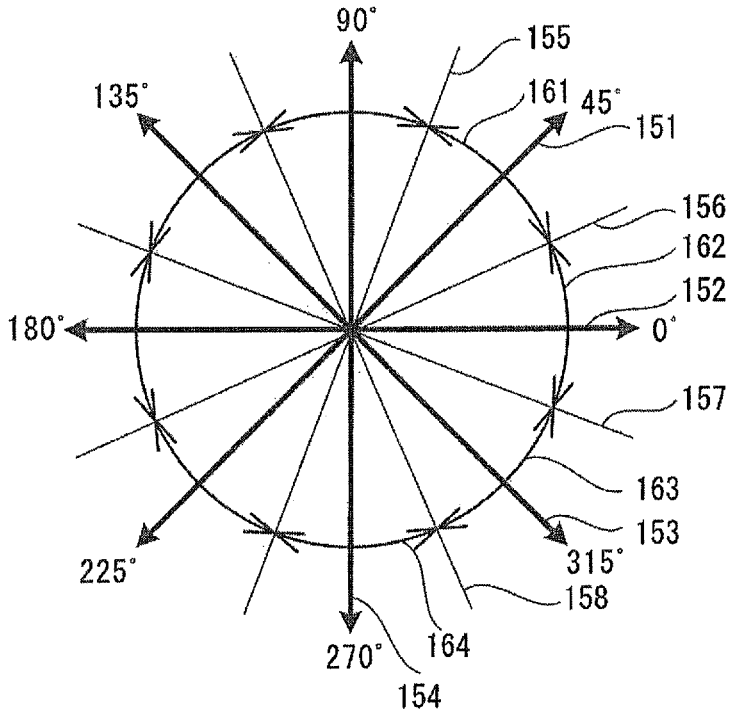
FIG. 13 is an explanatory diagram of angle ranges.

An overview of an identification method of the cutting needle 52 will be explained. FIG. 13 shows angle ranges 161, 162, 163 and 164 that are respectively associated, in advance, with the cutting needles 521, 522, 523 and 524 (refer to FIG. 2). In FIG. 13, arrows 151, 152, 153 and 154 respectively show directions of the cutting edges when the cutting needles 521, 522, 523 and 524 are viewed in a plan view.

Sections located between a straight line 155 and a straight line 156 indicate the angle ranges 161. The straight line 155 is a straight line that equally divides an acute angle between the arrows 154 and 151. The straight line 156 is a straight line that equally divides an acute angle between the arrows 151 and 152. Sections located between the straight line 156 and a straight line 157 indicate the angle ranges 162. The straight line 157 is a straight line that equally divides an acute angle between the arrows 152 and 153. Sections located between the straight line 157 and a straight line 158 indicate the angle ranges 163. The straight line 158 is a straight line that equally divides an acute angle between the arrows 153 and 154. Sections located between the straight line 158 and the straight line 155 indicate the angle ranges 164.

The angle ranges 161 indicate a range from 22.5° to 67.5° and a range from 202.5° to 247.5°. The angle ranges 162 indicate a range from 337.5° to 22.5° and a range from 157.5° to 202.5°. The angle ranges 163 indicate a range from 112.5° to 157.5° and a range from 292.5° to 337.5°. The angle ranges 164 indicate a range from 67.5° to 112.5° and a range from 247.5° to 292.5°. The angle ranges 161, 162, 163 and 164 are respectively associated with the cutting needles 521, 522, 523 and 524. The CPU 61 identifies which of the angle ranges 161, 162, 163 and 164 the extending direction of the tangent line Q(i)(j) is included in, and thereby identifies the cutting needle 52 corresponding to the needle drop point P(i). Details are as follows.

As shown in FIG. 7, in a case where the extending direction of the tangent line Q(i)(j) identified at step S35 is included in the angle ranges 161 (yes at step S45), the CPU 61 identifies the cutting needle 521 that corresponds to the angle ranges 161, as a cutting needle R(i)(j) that corresponds to the needle drop point P(i) (step S47). The CPU 61 associates the data indicating the cutting needle R(i)(j) (the cutting needle 521) with the needle drop point P(i) and stores the data in the table 141 (refer to FIG. 11) (step S47). The CPU 61 proceeds to processing at step S59.

In a case where the extending direction of the tangent line Q(i)(j) identified at step S35 is included in the angle ranges 162 (no at step S45, yes at step S49), the CPU 61 identifies the cutting needle 522 that corresponds to the angle ranges 162, as the cutting needle R(i)(j) that corresponds to the needle drop point P(i) (step S51). The CPU 61 associates the data indicating the cutting needle R(i)(j) (the cutting needle 522) with the needle drop point P(i) and stores the data in the table 141 (refer to FIG. 11) (step S51). The CPU 61 proceeds to the processing at step S59.

In a case where the extending direction of the tangent line Q(i)(j) identified at step S35 is included in the angle ranges 163 (no at step S49, yes at step S53), the CPU 61 identifies the cutting needle 523 that corresponds to the angle ranges 163, as the cutting needle R(i)(j) that corresponds to the needle drop point P(i) (step S55). The CPU 61 associates the data indicating the cutting needle R(i)(j) (the cutting needle 523) with the needle drop point P(i) and stores the data in the table 141 (refer to FIG. 11) (step S55). The CPU 61 proceeds to the processing at step S59.

In a case where the extending direction of the tangent line Q(i)(j) identified at step S35 is included in the angle ranges 164 (no at step S53), the CPU 61 identifies the cutting needle 524 that corresponds to the angle ranges 164, as the cutting needle R(i)(j) that corresponds to the needle drop point P(i) (step S57). The CPU 61 associates the data indicating the cutting needle R(i)(j) (the cutting needle 524) with the needle drop point P(i) and stores the data in the table 141 (refer to FIG. 11) (step S57). The CPU 61 proceeds to the processing at step S59. Note that, hereinafter, the data indicating the cutting needle R(i)(j) that is stored in the table 141 as described above is also simply referred to as the cutting needle R(i)(j).

The direction of the cutting edge of the cutting needle 52 identified for each of the needle drop points as described above may favorably approximate the direction of the tangent line of the pattern line at each of the needle drop points. Therefore, when the sewing machine 1 forms cuts by piercing the identified cutting needle 52 into the work cloth 39, cuts having a good appearance can be formed along the pattern line. Further, the CPU 61 identifies the cutting needle 52 based on the direction in which the line segment that connects adjacent two needle drop points extends. Therefore, complicated processing to calculate the actual tangent line of the pattern line at each of the needle drop points is not required. Thus, the CPU 61 can easily and accurately identify the cutting needle 52 that is to be inserted at each of the needle drop points.

Next, the CPU 61 performs processing (correction processing, refer to FIG. 8) to correct the cutting needles R(i)(j) stored in the table 141 (step S59). In the correction processing, in order to reliably cut the warp threads and the weft threads of the work cloth 39 using the cutting needle 52, the CPU 61 corrects the cutting needles R(i)(j) each identified at one of step 47, step S51, step S55 and step S57, if necessary, based on the extending directions of the warp threads and the well threads identified at step S11 (refer to FIG. 5). A reason why the correction is necessary is as follows.

Figure 14:
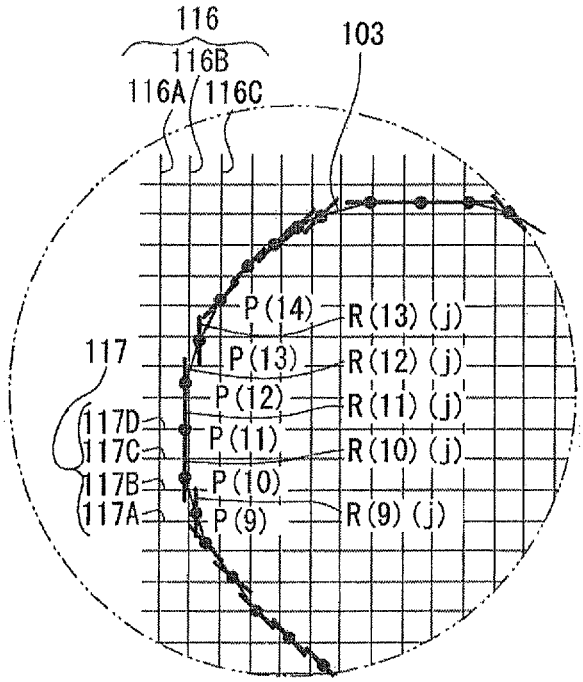
FIG. 14 is an explanatory diagram of cuts formed at the needle drop points.

For example, as shown in FIG. 14, the cutting needle 524 (refer to FIG. 2) is selected as cutting needles R(9)(j) to R(13)(j) that correspond to the needle drop points P(9) to P(13). The extending direction of warp threads 116 of the work cloth 39 is substantially the same as the front-rear direction of the sewing machine 1, and approximates the direction of the cutting edge of the cutting needle 524. In this case, since the extending direction of well threads 117 is orthogonal to the extending direction of the warp threads 116, the direction in which the cutting edge of the cutting needle 524 extends intersects with the extending direction of the well threads 117.

When the cutting needle 524 is inserted at the needle drop point P(9), well threads 117A and 117B that intersect with the cutting needle 524 are cut. When the cutting needle 524 is inserted at the needle drop point P(10), the well thread 117B and a well thread 117C that intersect with the cutting needle 524 are cut. When the cutting needle 524 is inserted at the needle drop point P(11), a well thread 117D that intersects with the cutting needle 524 is cut. As a result, the well threads 117 of the work cloth 39 can reliably be cut.

In contrast to this, the needle drop points P(9) and P(13) are arranged between warp threads 116B and 116C and the needle drop points P(10), P(11) and P(12) are arranged between a warp thread 116A and the warp thread 116B. Therefore, when the cutting needle 524 is inserted at the needle drop points P(9) to P(13), the cutting needle 524 and the warp thread 116B do not intersect with each other. As a result, the warp thread 116B is not cut. For that reason, when the cutting needles 52 are sequentially inserted into the work cloth 39 along the pattern line 103, the warp thread 116B remains uncut. Therefore, a heart-shaped section (refer to FIG. 10) surrounded by the pattern line 103 cannot be cut off from the work cloth 39. To address this, the present embodiment makes it possible to reliably cut the warp thread 116B by correcting the cutting needle 524 that is to be inserted at the needle drop points P(9) to P(13).

Figure 8:
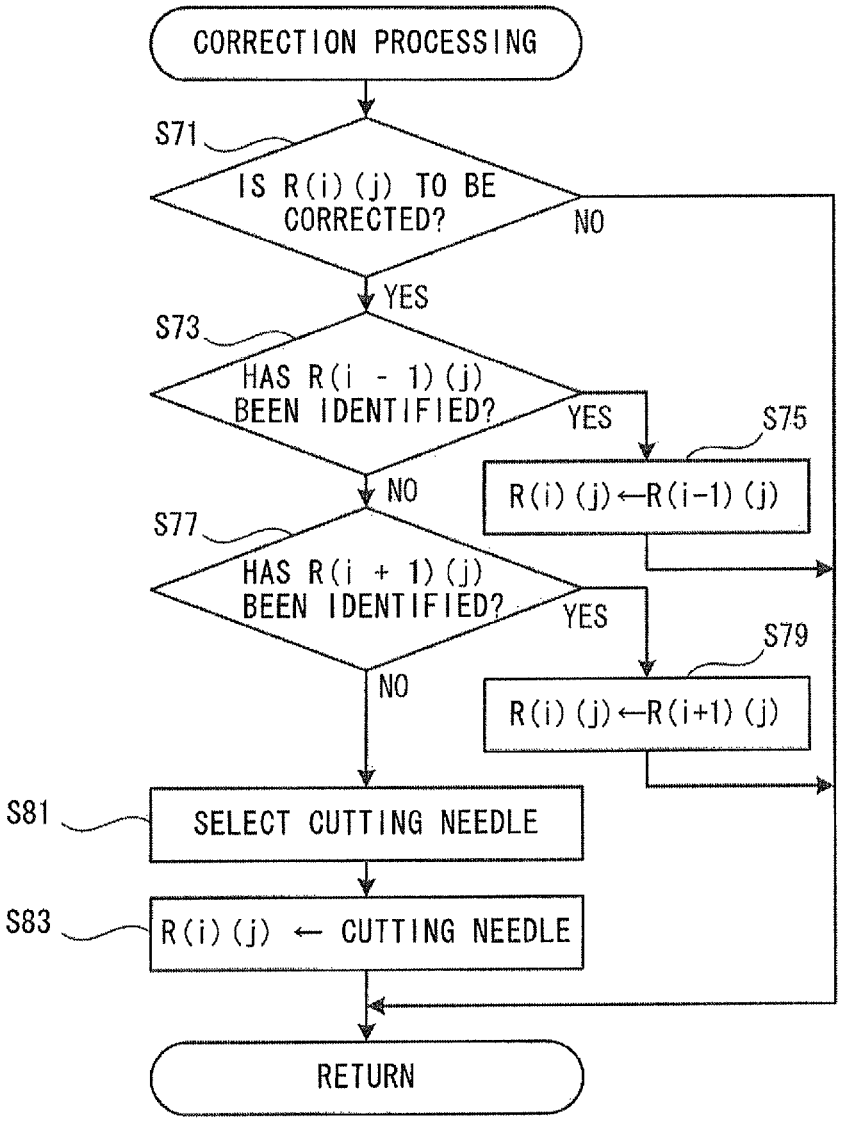
FIG. 8 is a flowchart of correction processing.

The correction processing will be explained with reference to FIG. 8. In the correction processing, first, the CPU 61 determines whether or not to perform correction of the cutting needle R(i)(j) by determining whether or not the direction of the cutting edge of each of the cutting needles 52 identified at step S45 to step S57 (refer to FIG. 7) substantially matches the extending direction of the warp threads 116 or the weft threads 117 (refer to FIG. 14) of the work cloth 39 (step S71). A specific method for the determination is as follows.

The CPU 61 calculates an absolute value of a difference between an angle that indicates the extending direction of the warp threads 116 and an angle that indicates the direction of the cutting edge of the cutting needle 52. Further, the CPU 61 calculates an absolute value of a difference between an angle that indicates the extending direction of the weft threads 117 and an angle that indicates the direction of the cutting edge of the cutting needle 52. The CPU 61 compares the calculated two absolute values with a predetermined threshold value. In a case where the smaller value of the two absolute values is smaller than the predetermined threshold value (for example, 5°), the CPU 61 determines that the correction of the cutting needle R(i)(j) is to be performed (yes at step S71). This is because, in this case, an amount of the angle difference between the direction in which the cutting edge of the cutting needle 52 extends and the extending direction of the warp threads 116 or the weft threads 117 is small, and there is a high possibility that the warp threads 116 or the weft threads 117 cannot be cut. On the other hand, in a case where the smaller value of the two absolute values is equal to or larger than the predetermined threshold value, the CPU 61 determines that the correction of the cutting needle R(i)(j) is not to be performed (no at step S71). This is because, in this case, the angle difference between the direction of the cutting edge of the cutting needle 52 and each of the extending directions of the warp threads 116 and the weft threads 117 is large, and there is a high possibility that the cutting needle 52 can reliably cut the warp threads 116 and the weft threads 117.

In a case where the CPU 61 determines that the correction of the cutting needle R(i)(j) is not to be performed (no at step S71), the CPU 61 ends the correction processing and returns to the needle determination processing (refer to FIG. 7). In a case where the CPU 61 determines that the correction of the cutting needle R(i)(j) is to be performed (yes at step S71), the CPU 61 determines whether or not the cutting needle R(i−1)(j) has already been identified (step S73). The cutting needle R(i−1)(j) corresponds to a needle drop point P(i−1) immediately preceding the needle drop point P(i), among two other needle drop points P(i−1) and P(i+1) adjacent to the needle drop point P(i). In a case where the correction processing has already been performed for the needle drop point P(i−1) and the cutting needle R(i−1)(j) corresponding to the needle drop point P(i−1) has been identified (yes at step S73), the cutting edge of the cutting needle R(i−1)(j) is oriented in a direction in which the warp threads 116 and the weft threads 117 of the work cloth 39 can be reliably cut. The CPU 61 corrects the cutting needle R(i)(j) by replacing the cutting needle R(i)(j) stored in the table 141 with the cutting needle R(i−1)(j) (step S75). The CPU 61 ends the correction processing and returns to the needle determination processing (refer to FIG. 7).

In a case where the cutting needle R(i−1)(j) corresponding to the needle drop point P(i−1) that is immediately preceding the needle drop point P(i) has not been identified (no at step S73), the CPU 61 determines whether or not the cutting needle R(i+1)(j) has already been identified (step S77). The cutting needle R(i+1)(j) corresponds to the needle drop point P(i+1) immediately after the needle drop point P(i). In a case where the cutting needle R(i+1)(j) corresponding to the needle drop point P(i+1) has already been identified (yes at step S77), the cutting edge of the cutting needle R(i+1)(j) is oriented in a direction in which the warp threads 116 and the weft threads 117 of the work cloth 39 can be reliably cut. The CPU 61 corrects the cutting needle R(i)(j) by replacing the cutting needle R(i)(j) stored in the table 141 with the cutting needle R(i+1)(j) (step S79). The CPU 61 ends the correction processing and returns to the needle determination processing (refer to FIG. 7).

For example, when the variable i is 0, it is determined that the cutting needle R(74)(j) corresponding to the needle drop point P(74) (refer to FIG. 10) that is immediately preceding the needle drop point P(0) has not been identified (no at step S73). However, if part of the processing that identifies the cutting needle 52 based on the same pattern has been performed, there are cases in which the cutting needle R(1)(j) corresponding to the needle drop point P(1) immediately after the needle drop point P(0) has already been identified and stored in the table 141 (yes at step S77). In this type of case, the cutting needle R(0)(j) corresponding to the needle drop point P(0) is replaced with the cutting needle R(1)(j) that has already been stored in the table 141.

In a case where the cutting needle R(i+1)(j) corresponding to the needle drop point P(i+1) immediately after the needle drop point P(i) has not yet been identified (no at step S77), the CPU 61 selects, from among the cutting needles 521 to 524, the cutting needle 52 that can reliably cut the warp threads 116 and the weft threads 117 of the work cloth 39 (step S81). The CPU 61 selects the cutting needle 52 so that the smaller value of the above-described two absolute values is equal to or more than the predetermined threshold value (for example, 5°). The CPU 61 corrects the cutting needle R(i)(j) by replacing the cutting needle R(i)(j) corresponding to the needle drop point P(i) that is stored in the table 141 with data indicating the selected cutting needle 52 (step S83). The CPU 61 ends the correction processing and returns to the needle determination processing (refer to FIG. 7).

As shown in FIG. 7, after the correction processing (step S59), the CPU 61 adds 1 to the variable j and updates the variable j (step S61). The CPU 61 returns to the processing at step S41.

After the cutting needles R(i)(j) corresponding to the needle drop points P(i) are all identified as described above (yes at step S41), the CPU 61 determines whether or not the cutting needle R(i)(0) and the cutting needle R(i)(1) that correspond to the same needle drop point P(i) match each other. In a case where the cutting needle R(i)(0) and the cutting needle R(i)(1) match each other, the CPU 61 deletes the cutting needle R(i)(1) from the table 141 and leaves the cutting needle R(i)(0) only (step S42). This can inhibit the same cutting needle 52 from being inserted at the one needle drop point P(i) a plurality of times. The CPU 61 updates the variable i by adding 1 to the variable i (step S43), and returns to the processing at step S33.

By performing the above processing, the CPU 61 can generate the cut data with which the cutting needle 52 that can reliably cut the warp threads 116 and the weft threads 117 is used, instead of using the cutting needle 52 that may not cut the warp threads 116 or the weft threads 117 of the work cloth 39. Further, the CPU 61 can easily identify, as the cutting needle 52 to be used instead, the cutting needle 52 corresponding to the needle drop point P(i−1) immediately preceding the needle drop point P(i) or corresponding to the needle drop point P(i+1) immediately after the needle drop point P(i). Further, the same cutting needle 52 tends to be used continuously. Accordingly, when the sewing machine 1 operates based on the cut data generated based on the table 141, frequent switching of the cutting needle 52 can be inhibited. The sewing machine 1 can shorten the time required until the sewing machine 1 completes the forming of all the cuts in the work cloth 39 along the pattern line of the specified pattern.

As the needle determination processing is performed as described above, the cutting needle 52 is identified for each of the needle drop points, and the table 141 is generated. As shown in FIG. 5, the CPU 61 then generates the cut data that is necessary to insert the cutting needles R(i)(j) stored in the table 141 at the corresponding needle drop points P(i) in order (step S19). Based on the generated cut data, the CPU 61 drives the sewing needle drive portion 120 and the sewing target drive portion 130, and thereby sequentially inserts the cutting needles 52 into the work cloth 39 held by the embroidery frame 84. Thus, the sewing machine 1 forms the cuts in the work cloth 39 along the pattern line (step S21). The CPU 61 ends the main processing.

Figure 15:
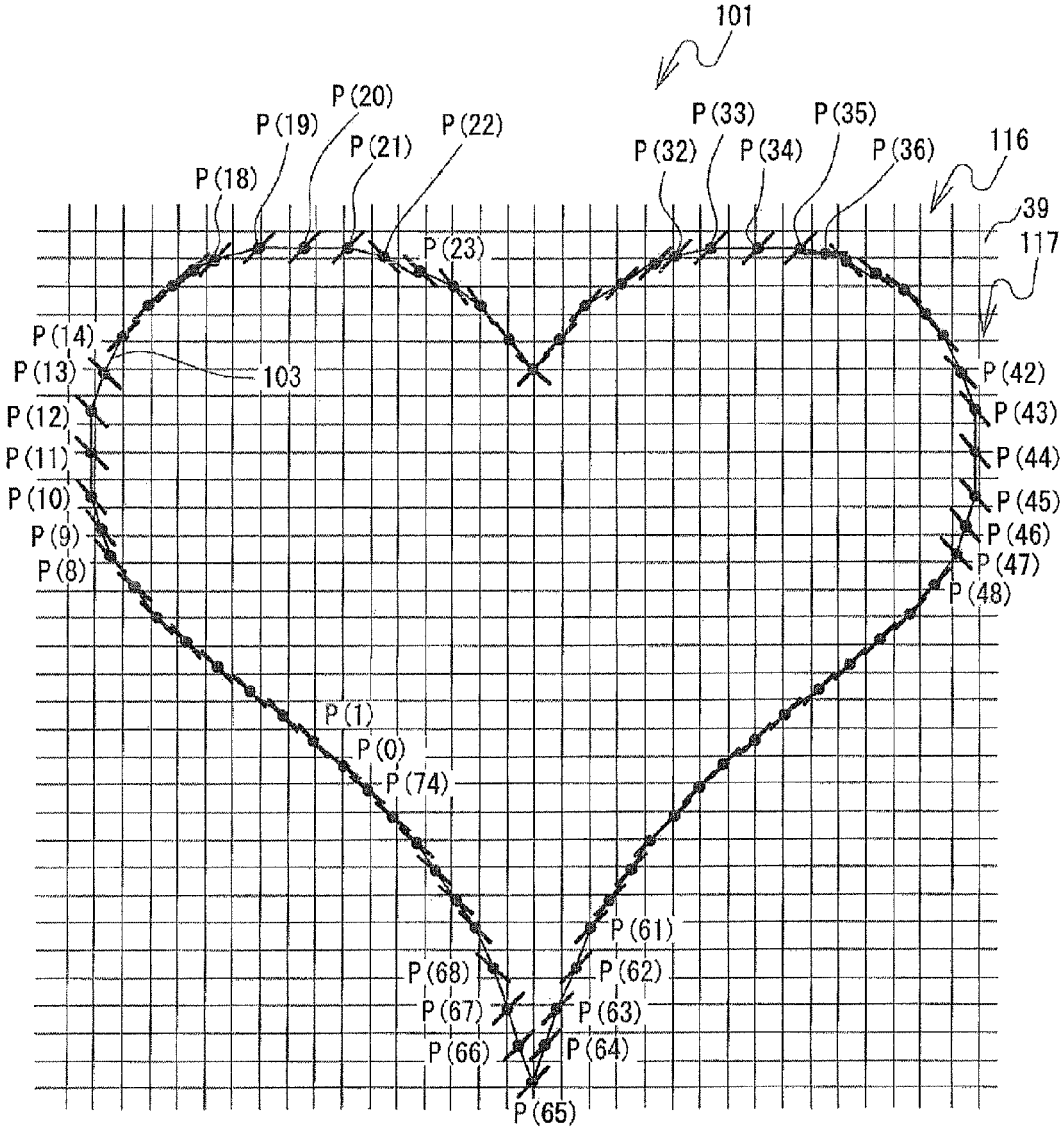
FIG. 15 is another explanatory diagram of the cuts formed at the needle drop points.

A specific example in which the cutting needles R(i)(j) corresponding to the needle drop points P(i) are sequentially determined will be explained with reference to FIG. 15. The cutting needle 523 is selected as the cutting needle R(8)(j) corresponding to the needle drop point P(8) (yes at step S53, step S55 (refer to FIG. 7)). An angle difference between the direction of the cutting edge of the cutting needle 523 and the extending direction of the warp threads 116, and an angle difference between the direction of the cutting edge of the cutting needle 523 and the extending direction of the weft threads 117 are large. Therefore, the cutting needle 523 is not corrected (no at step S71 (refer to FIG. 8)).

Next, the cutting needle 524 is selected as the cutting needle R(9)(j) corresponding to the needle drop point P(9) (no at step S53, step S57 (refer to FIG. 7)). An angle difference between the direction of the cutting edge of the cutting needle 524 and the extending direction of the warp threads 116 of the work cloth 39 is small. Therefore, the CPU 61 needs to correct the cutting needle 524 to another one of the cutting needles 52 (yes at step S71 (refer to FIG. 8)). The cutting needle 523 corresponding to the needle drop point P(8) that is immediately preceding the needle drop point P(9) has been identified (yes at step S73 (refer to FIG. 8)). Therefore, the cutting needle 524 corresponding to the needle drop point P(9) is corrected to the cutting needle 523 corresponding to the immediately preceding needle drop point P(8) (step S75). Next, the cutting needle 524 is selected as the cutting needle R(10)(j) corresponding to the needle drop point P(10) (no at step S53, step S57 (refer to FIG. 7)). The CPU 61 needs to correct the cutting needle 524 to another one of the cutting needles 52 (yes at step S71 (refer to FIG. 8)). The cutting needle 52 corresponding to the needle drop point P(9) that is immediately preceding the needle drop point P(10) has been corrected to the cutting needle 523 (yes at step S73 (refer to FIG. 8)). Therefore, the cutting needle 524 corresponding to the needle drop point P(10) is corrected to the cutting needle 523 corresponding to the immediately preceding needle drop point P(9) (step S75). Similar processing is also performed for the needle drop points P(11) to P(13).

The cutting needle 521 is selected as the cutting needle R(18)(j) corresponding to the needle drop point P(18) (yes at step S45, step S47 (refer to FIG. 7)). An angle difference between the direction of the cutting edge of the cutting needle 521 and the extending direction of the warp threads 116, and an angle difference between the direction of the cutting edge of the cutting needle 521 and the extending direction of the weft threads 117 are large. Therefore, the cutting needle 521 is not corrected (no at step S71 (refer to FIG. 8)). The cutting needle 522 is selected as the cutting needle R(19)(j) corresponding to the needle drop point P(19) (yes at step S49, step S51 (refer to FIG. 7)). An angle difference between the direction of the cutting edge of the cutting needle 522 and the extending direction of the weft threads 117 of the work cloth 39 is small. Therefore, the CPU 61 needs to correct the cutting needle 522 to another one of the cutting needles 52 (yes at step S71 (refer to FIG. 8)). The cutting needle 521 corresponding to the needle drop point P(18) that is immediately preceding the needle drop point P(19) has been identified (yes at step S73 (refer to FIG. 8)). Therefore, the cutting needle 522 corresponding to the needle drop point P(19) is corrected to the cutting needle 521 corresponding to the immediately preceding needle drop point P(18) (step S75). Similar processing is also performed for the needle drop points P(20) and P(21). Further, the correction processing is also performed in the same manner for each of the cutting needles 52 corresponding to the needle drop points P(32) to P(35), the needle drop points P(42) to P(47), and the needle drop points P(61) to P(67).

The cut data is generated based on the table 141 generated as described above. The sewing machine 1 operates based on the generated cut data, and repeatedly inserts the cutting needle 52 into the work cloth 39. As a result, the cuts are formed in the work cloth 39 along the pattern line 103 as shown in FIG. 15. The cutting needle 523 corresponding to the needle drop points P(10) to P(13) and P(42) to P(47), and the cutting needle 521 corresponding to the needle drop points P(61) to P(67) can reliably cut the warp threads 116 of the work cloth 39. Further, the cutting needle 521 corresponding to the needle drop points P(19) to P(21) and P(33) to P(35) can reliably cut the weft threads 117 of the work cloth 39.

As explained above, the sewing machine 1 identifies the cutting needle 52 that is to be inserted at each of the needle drop points P(i), based on the direction of the tangent line of the pattern line (more specifically, the direction in which the pattern line extends at the needle drop point). Therefore, the sewing machine 1 can form smooth cuts in the work cloth 39 along the pattern line, by piercing the identified cutting needle 52 into the work cloth 39 at each of the needle drop points P(i). Further, among the identified cutting needles 52, the sewing machine 1 replaces the cutting needle 52 that may not be able to cut the warp threads 116 or the weft threads 117 that form the work cloth 39, with the cutting needle 52 that can cut the warp threads 116 and the weft threads 117. Consequently, the sewing machine 1 can reliably cut the warp threads 116 and the weft threads 117 of the work cloth 39. Thus, the sewing machine 1 can form the cuts in the work cloth 39 along the pattern line of the specified pattern.

Note that the above-described embodiment can be modified in various ways. For example, instead of identifying the cutting needle separately for each of the needle drop points, the CPU 61 may identify only one cutting needle 52 that corresponds to all the needle drop points, based on the extending direction of the fibers (one or more of the extending direction of the warp threads 116 and the extending direction of the weft threads 117). The sewing machine 1 may form the cuts in the work cloth 39 along the pattern line, by piercing the identified cutting needle 52 at all the needle drop points. Hereinafter, a modified example of the present invention will be explained.

Figure 16:
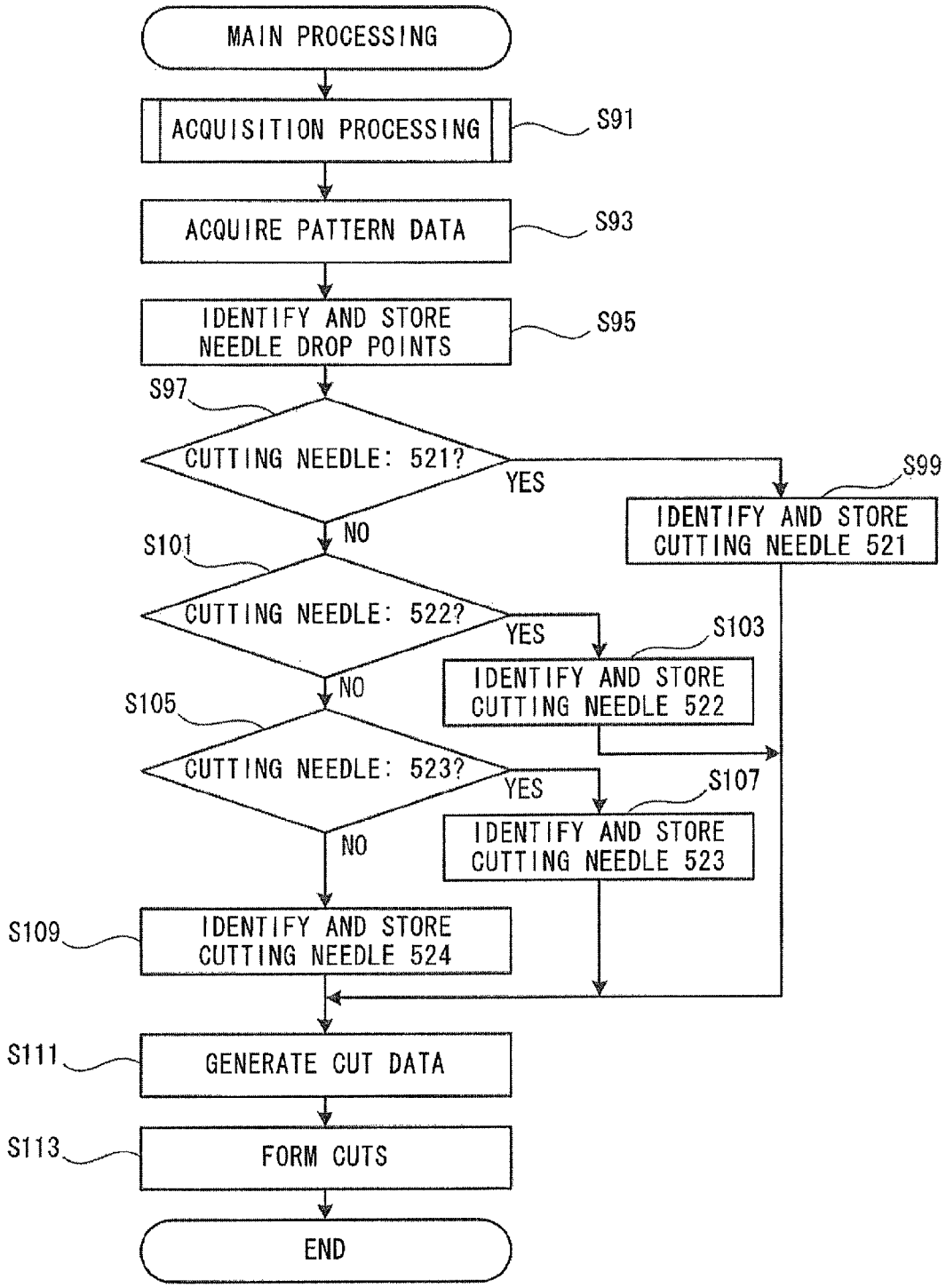
FIG. 16 is a flowchart of main processing according to a modified example.

Main processing according to the modified example of the present invention will be explained with reference to FIG. 16. Hereinafter, explanation of the same processing as that of the main processing according to the above-described embodiment will be simplified. In the main processing according to the modified example, first, the CPU 61 performs the processing (the acquisition processing, refer to FIG. 6) that acquires the extending directions of the warp threads 116 and the weft threads 117 of the work cloth 39 held by the embroidery frame 84 (refer to FIG. 3) (step S91). Next, pattern data of the pattern input by the user is acquired (step S93). The CPU 61 stores the acquired pattern data in the RAM 63 (step S93). Next, the CPU 61 identifies, as needle drop points, given points on the pattern line indicated by the pattern data stored in the RAM 63 (step S95). The CPU 61 stores coordinate data that indicates positions of the identified needle drop points in the table 141 (refer to FIG. 11) (step S95). The processing from step S91 to step S95 is the same as the processing at step S11 to step S15 of the main processing (refer to FIG. 5) according to the above-described embodiment.

The CPU 61 selects, from among the cutting needles 521 to 524, the cutting needle 52 that can reliably cut the warp threads 116 and the weft threads 117 of the work cloth 39. The CPU 61 calculates an absolute value of a difference between an angle that indicates the extending direction of the warp threads 116 and an angle that indicates the direction of the cutting edge of the selected cutting needle 52. Further, the CPU 61 calculates an absolute value of a difference between an angle that indicates the extending direction of the weft threads 117 and an angle that indicates the direction of the cutting edge of the selected cutting needle 52. The cutting needle 52 is selected such that the smaller value of the two absolute values is equal to or larger than a predetermined threshold value (for example, 5°). In a case where the CPU 61 selects the cutting needle 521 (yes at step S97), the CPU 61 identifies the cutting needle 521 as the cutting needle 52 that corresponds to all the needle drop points P(i) (step S99). The CPU 61 associates the data indicating the cutting needle 521 with all the needle drop points P(i) and stores the data in the table 141 (step S99). Then, the CPU 61 proceeds to processing at step S111.

In a case where the CPU 61 selects the cutting needle 522 (no at step S97, yes at step S101), the CPU 61 identifies the cutting needle 522 as the cutting needle 52 that corresponds to all the needle drop points P(i) (step S103). The CPU 61 associates the data indicating the cutting needle 522 with all the needle drop points P(i) and stores the data in the table 141 (step S103). Then, the CPU 61 proceeds to the processing at step S111.

In a case where the CPU 61 selects the cutting needle 523 (no at step S101, yes at step S105), the CPU 61 identifies the cutting needle 523 as the cutting needle 52 that corresponds to all the needle drop points P(i) (step S107). The CPU 61 associates the data indicating the cutting needle 523 with all the needle drop points P(i) and stores the data in the table 141 (step S107). Then, the CPU 61 proceeds to the processing at step S111.

In a case where the CPU 61 selects the cutting needle 524 (no at step S105), the CPU 61 identifies the cutting needle 524 as the cutting needle 52 that corresponds to all the needle drop points P(i) (step S109). The CPU 61 associates the data indicating the cutting needle 524 with all the needle drop points P(i) and stores the data in the table 141 (step S109). Then, the CPU 61 proceeds to the processing at step S111.

After the table 141 is generated as described above, the CPU 61 generates cut data that is necessary to insert the cutting needle stored in the table 141 at the corresponding needle drop points P(i) in order (step S111). The CPU 61 drives the sewing needle drive portion 120 and the sewing target drive portion 130 based on the generated cut data, and thereby sequentially inserts the cutting needle 52 into the work cloth 39 held by the embroidery frame 84. By doing this, the sewing machine 1 forms the cuts in the work cloth 39 along the pattern line (step S113). The CPU 61 ends the main processing.

Figure 17:
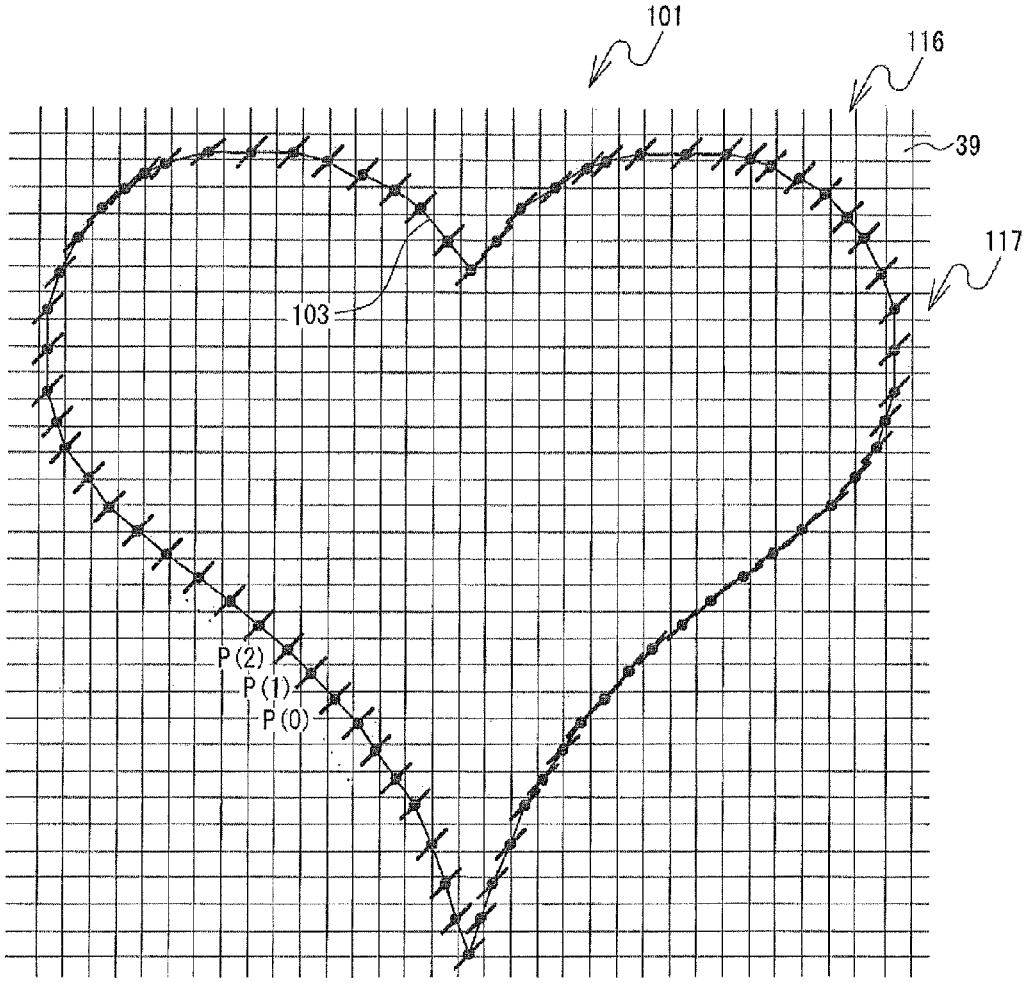
FIG. 17 is a diagram showing cuts formed in the main processing according to the modified example.

FIG. 17 shows an example of the cuts that are formed in the work cloth 39 along the pattern line 103 in a case where the cut data is generated based on the table 141 generated in the main processing of the modified example and the sewing machine 1 operates based on the generated cut data. In this example, the cutting needle 521 is inserted at all the needle drop points P(i). Since the angle difference between the direction of the cutting edge of the cutting needle 521 and each of the extending directions of the warp threads 116 and the weft threads 117 of the work cloth 39 is large, the cutting needle 521 can reliably cut both the warp threads 116 and the weft threads 117. Thus, the sewing machine 1 can reliably cut the warp threads 116 and the weft threads 117 of the work cloth 39 and can form the cuts in the work cloth 39 along the pattern line 103.

As described above, in the modified example, the sewing machine 1 uses only the cutting needle 521 to form the cuts in the work cloth 39. Therefore, the processing in which the CPU 61 determines the cutting needle 52 for each of the needle drop points is not required. Therefore, the sewing machine 1 can easily determine the cutting needle 52. The sewing machine 1 needs not switch the cutting needle 521 to another one of the cutting needles 52 during operation, and it is thus possible to save the time required to switch the cutting needle 521 to another one of the cutting needles 52. Thus, the sewing machine 1 can shorten the time for the sewing machine 1 to complete the forming of all the cuts in the work cloth 39 along the pattern line of the specified pattern.

The cut data may be generated not by the sewing machine 1 but by an external device. For example, a known personal computer may be used as the external device. For example, the cut data generated by a CPU of the personal computer as the external device may be stored on a memory card. The sewing machine 1 may be provided with a card slot not shown in the drawings, and when the memory card is inserted into the card slot, the sewing machine 1 may read and acquire the cut data stored on the memory card. The sewing machine 1 may form the cuts in the work cloth 39 by driving the sewing needle drive portion 120 and the sewing target drive portion 130 based on the acquired cut data.

The number of the cutting needles 52 that can be attached to the sewing machine 1 is not limited to four as in the above-described embodiment, and it may be a number other than four. At step S17 of the main processing shown in FIG. 5, the cutting needle may be identified by another method. For example, the CPU 61 may calculate an actual tangent line of the pattern line at the needle drop point P(i), and may identify the cutting needle 52 based on an angle of the calculated tangent line. The method for determining whether or not to replace the cutting needle 52 with another one of the cutting needles 52 is not limited to the above-described method. For example, data indicating an associated relationship between the direction of the cutting edge of the cutting needle 52 and another one of the cutting needles 52 may be generated based on the extending direction of the fibers that form the work cloth 39, and the generated data may be stored in the EEPROM 64. The sewing machine 1 may replace the identified cutting needle 52 with another one of the cutting needles 52 based on the stored data indicating the associated relationship.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. An apparatus comprising:

a processor; and a memory configured to store computer-readable instructions that instruct the apparatus to execute steps comprising:

acquiring pattern data, the pattern data being data representing a position of a point on a pattern line in a case where cuts are formed in a work cloth along the pattern line, which is a line indicating a shape of a pattern;

identifying, as a plurality of cutting needle drop points, a plurality of points on the pattern line, each of the plurality of cutting needle drop points being a position at which a cutting needle is to be inserted into the work cloth in order to form a cut;

identifying, as a corresponding cutting needle, one of a plurality of cutting needles configured to be attachable to a plurality of needle bars of a multi-needle sewing machine in a state in which directions of cutting edges of the plurality of cutting needles are different from each other, the identifying being performed for each of the plurality of cutting needle drop points, based on a direction in which the pattern line extends at each of the plurality of cutting needle drop points;

storing cutting needle drop point data and cutting needle data in association with each other in the memory, the cutting needle drop point data being data indicating each of the plurality of cutting needle drop points, and the cutting needle data being data indicating the cutting needle identified corresponding to each of the plurality of cutting needle drop points;

identifying an extending direction of fibers that form the work cloth;

replacing the cutting needle data that is included in the cutting needle data stored in the memory and in which an angle between the extending direction and the direction of the cutting edge of the cutting needle indicated by the cutting needle data does not satisfy a predetermined relationship, with other data indicating another cutting needle which is among the plurality of cutting needles and in which the angle satisfies the predetermined relationship; and generating cut data based on the cutting needle drop point data and the cutting needle data stored in the memory, the cut data being data for the multi-needle sewing machine to insert the corresponding cutting needle at each of the plurality of cutting needle drop points along the pattern line.

2. The apparatus according to claim 1, wherein the replacing the cutting needle data includes:

determining, based on the cutting needle drop point data and the cutting needle data stored in the memory, whether the angle satisfies the predetermined relationship in accordance with an order of the plurality of cutting needle drop points that are adjacent on the pattern line, and replacing, in a case where the angle does not satisfy the predetermined relationship, the cutting needle data with other cutting needle data that corresponds to the cutting needle drop point data of a previous cutting needle drop point in the order.

3. The apparatus according to claim 1, wherein the identifying the cutting needle for each of the plurality of cutting needle drop points includes identifying the cutting needle based on an extending direction of a line segment that connects each of the plurality of cutting needle drop points with another adjacent cutting needle drop point, and on the directions of the cutting edges.

4. The apparatus according to claim 1, wherein the apparatus is the multi-needle sewing machine, and the computer-readable instructions further instruct the multi-needle sewing machine to execute steps comprising:

generating a signal based on the cut data, the multi-needle sewing machine being configured to insert the corresponding cutting needle at each of the plurality of cutting needle drop points along the pattern line based on the generated signal.

5. An apparatus comprising:

a processor; and a memory configured to store computer-readable instructions that instruct the apparatus to execute steps comprising:

acquiring pattern data, the pattern data being data representing a position of a point on a pattern line in a case where cuts are formed in a work cloth along the pattern line, which is a line indicating a shape of a pattern;

identifying, as a plurality of cutting needle drop points, a plurality of points on the pattern line, each of the plurality of cutting needle drop points being a position at which a cutting needle is to be inserted into the work cloth in order to form a cut;

identifying an extending direction of fibers that form the work cloth;

identifying, among a plurality of cutting needles configured to be attachable to a plurality of needle bars of a multi-needle sewing machine in a state in which directions of cutting edges of the plurality of cutting needles are different from each other, a cutting needle in which an angle between the identified extending direction and the direction of the cutting edge satisfies a predetermined relationship; and generating cut data, the cut data being data for the multi-needle sewing machine to insert the identified cutting needle at each of the plurality of cutting needle drop points on the pattern line.

6. The apparatus according to claim 5, wherein the apparatus is the multi-needle sewing machine, and the computer-readable instructions further instruct the multi-needle sewing machine to execute steps comprising:

generating a signal based on the cut data, the multi-needle sewing machine being configured to insert the corresponding cutting needle at each of the plurality of cutting needle drop points along the pattern line based on the generated signal.

7. A non-transitory computer-readable medium storing computer-readable instructions that instruct an apparatus to execute steps comprising:

acquiring pattern data, the pattern data being data representing a position of a point on a pattern line in a case where cuts are formed in a work cloth along the pattern line, which is a line indicating a shape of a pattern;

identifying, as a plurality of cutting needle drop points, a plurality of points on the pattern line, each of the plurality of cutting needle drop points being a position at which a cutting needle is to be inserted into the work cloth in order to form a cut;

identifying, as a corresponding cutting needle, one of a plurality of cutting needles configured to be attachable to a plurality of needle bars of a multi-needle sewing machine in a state in which directions of cutting edges of the plurality of cutting needles are different from each other, the identifying being performed for each of the plurality of cutting needle drop points, based on a direction in which the pattern line extends at each of the plurality of cutting needle drop points;

storing cutting needle drop point data and cutting needle data in association with each other in the memory, the cutting needle drop point data being data indicating each of the plurality of cutting needle drop points, and the cutting needle data being data indicating the cutting needle identified corresponding to each of the plurality of cutting needle drop points;

identifying an extending direction of fibers that form the work cloth;

replacing the cutting needle data that is included in the cutting needle data stored in the memory and in which an angle between the extending direction and the direction of the cutting edge of the cutting needle indicated by the cutting needle data does not satisfy a predetermined relationship, with other data indicating another cutting needle which is among the plurality of cutting needles and in which the angle satisfies the predetermined relationship; and generating cut data based on the cutting needle drop point data and the cutting needle data stored in the memory, the cut data being data for the multi-needle sewing machine to insert the corresponding cutting needle at each of the plurality of cutting needle drop points along the pattern line.

8. The non-transitory computer-readable medium according to claim 7, wherein the replacing the cutting needle data includes:

determining, based on the cutting needle drop point data and the cutting needle data stored in the memory, whether the angle satisfies the predetermined relationship in accordance with an order of the plurality of cutting needle drop points that are adjacent on the pattern line, and replacing, in a case where the angle does not satisfy the predetermined relationship, the cutting needle data with other cutting needle data that corresponds to the cutting needle drop point data of a previous cutting needle drop point in the order.

9. The non-transitory computer-readable medium according to claim 7, wherein the identifying the cutting needle for each of the plurality of cutting needle drop points includes identifying the cutting needle based on an extending direction of a line segment that connects each of the plurality of cutting needle drop points with another adjacent cutting needle drop point, and on the directions of the cutting edges.

* * * * *